United States Patent [19]

Kojima et al.

[11] Patent Number: 4,464,463

[45] Date of Patent: Aug. 7, 1984

[54] SILVER HALIDE COLOR PHOTOGRAPHIC LIGHT-SENSITIVE MATERIAL

[75] Inventors: Tetsuro Kojima; Hidetoshi Kobayashi, both of Kanagawa, Japan

[73] Assignee: Fuji Photo Film Co., Ltd., Kanagawa, Japan

[21] Appl. No.: 517,532

[22] Filed: Jul. 26, 1983

[30] Foreign Application Priority Data

Jul. 26, 1982 [JP] Japan ..... 57-129780

[51] Int. Cl.[3] ..... G03C 1/84

[52] U.S. Cl. ..... 430/512; 430/504; 430/505; 430/523; 430/536; 430/537; 430/543; 430/544; 430/548; 430/551; 430/554; 430/627; 430/957; 430/961

[58] Field of Search ..... 430/504, 505, 512, 523, 430/536, 537, 543, 544, 548, 551, 554, 627, 957, 962

[56] References Cited

U.S. PATENT DOCUMENTS

| | | | |
|---|---|---|---|
| 3,168,400 | 2/1965 | Blackmer et al. | 430/372 |
| 3,652,278 | 3/1972 | Asano et al. | 430/607 |
| 3,770,431 | 11/1973 | Gates et al. | 430/607 |
| 3,772,014 | 11/1973 | Scullard | 430/542 |
| 4,195,999 | 4/1980 | Adachi et al. | 430/512 |
| 4,199,363 | 4/1980 | Chen | 430/512 |
| 4,200,464 | 4/1980 | Shishido et al. | 430/510 |
| 4,203,716 | 5/1980 | Chen | 430/512 |
| 4,307,184 | 12/1981 | Beretta et al. | 430/627 |
| 4,368,258 | 1/1983 | Fujiwhara et al. | 430/546 |
| 4,396,698 | 8/1983 | Karino et al. | 430/551 |

*Primary Examiner*—J. Travis Brown

*Attorney, Agent, or Firm*—Sughrue, Mion, Zinn, Macpeak and Seas

[57] ABSTRACT

A silver halide color photographic light-sensitive material comprises a support having thereon a light-sensitive silver halide emulsion layer and a light-insensitive layer is disclosed. The material contains within the light-sensitive layer or the light-insensitive layer a compound capable of reacting with and fixing formaldehyde gas, said compound being represented by the general formula (I) or (II):

(I)

(II)

The compound capable of reacting with and fixing formaldehyde gas is loaded into an ultraviolet ray absorbing polymer latex comprised of a polymer having a repeating unit derived from a monomer represented by the general formula (III):

(III)

The substituents within the above formulae are defined within the specification. The color photographic light-sensitive material of the present invention has good film strength and a reduced layer thickness as well as excellent absorption characteristics in the 300 to 400 nm range, does not cause static marks caused by ultraviolet rays, and does not undergo deterioration of color reproduction. Furthermore, the material provides a color image having improved sharpness and is free from fading or discoloration due to light.

49 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material containing an ultraviolet ray absorbing polymer latex and, more particularly, it relates to a silver halide color photographic light-sensitive material containing an ultraviolet ray absorbing polymer latex into which is loaded a compound capable of reacting with and fixing formaldehyde gas during storage.

BACKGROUND OF THE INVENTION

Furniture and construction materials processed with formalin, adhesives containing formalin as a hardening agent, goods made of formaldehyde resins, leather goods tanned with formalin, clothes treated with formalin as a sterilzier or a bleaching agent, and the like are frequently utilized in daily life. As a result, there are many opportunities for conventional photographic light-sensitive materials to be brought into contact with formaldehyde gas released from these commonly used items.

In general, a silver halide color photographic light-sensitive material is composed of a support having coated thereon silver halide emulsion layers each of which has sensitivity in a different region of the spectrum and each of which contains a coupler capable of reacting with an oxidation product of a color developing agent to form a dye. For example, conventionally a color photographic light-sensitive material contains silver halide emulsion layers each of which is sensitive to blue light, green light or red light and contains a yellow coupler, a magenta coupler or a cyan coupler, respectively. After exposure to light, the photographic material is subjected to color development processing to form yellow, magenta and cyan color dye images in these silver halide emulsion layers, respectively. In such a multilayer color photographic light-sensitive material, each silver halide emulsion layer should be well balanced with respect to sensitivity and gradation in order to obtain an excellent color image. It is also desirable that the photographic properties of the photographic material are not changed during long periods of storage either before or after exposure to light until it is subjected to color development processing.

However, when a conventional silver halide color photographic light-sensitive material is brought into contact with formaldehyde gas before color development processing, not only is the coupler incorporated therein consumed by the reaction with formaldehyde but an undesirable product is also formed. As a result, degradation of the photographic properties, for example, a decrease in color density, an increase in color stain and fog, etc., occurs. The degradation of photographic properties due to formaldehyde gas is serious with the so-called 4-equivalent couplers having an active methylene group. Particularly, magenta couplers tend to be adversely affected by formaldehyde.

It has been proposed that a compound which reacts with formaldehyde be incorporated into a silver halide color photographic light-sensitive material containing a coupler for the purpose of preventing the degradation of photographic properties due to formaldehyde gas. However, known compounds for preventing the degradation of photographic properties due to formaldehyde gas in silver halide color photographic light-sensitive materials which contain an oil-soluble 4-equivalent magenta coupler, as described in Japanese Patent Publication Nos. 34675/71, 38418/73 and 23908/76, U.S. Pat. No. 3,770,431, *Research Disclosure,* Vol. 101, RD-10133, etc., only have a limited ability to fix formaldehyde gas. Therefore, adequate prevention of the degradation of the photographic properties cannot be obtained. Further, when such compounds are used in a large amount, a disadvantage is encountered in that the film properties of the photographic light-sensitive material are degraded.

In order to prevent the degradation of the film properties, it has been proposed to load an oleophilic compound into a polymer latex as described in Japanese Patent Application (OPI) Nos. 59943/76 and 126830/81 (the term "OPI" as used herein refers to a "published unexamined Japanese patent application"), etc. However, such a method has a disadvantage in that the thickness of the emulsion layer increases which results in degradation of sharpness.

SUMMARY OF THE INVENTION

Therefore, an object of the present invention is to provide a silver halide color photographic light-sensitive material having good film strength, when the photographic light-sensitive material contains an aldehyde gas scavenger in a sufficient amount for improving the resistivity to formaldehyde.

Another object of the present invention is to provide a silver halide color photographic light-sensitive material having a reduced emulsion layer thickness and thus improved sharpness.

Still another object of the present invention is to provide a silver halide color photographic light-sensitive material containing a novel ultraviolet ray absorbing polymer latex having an excellent absorption characteristic in the range of 300 nm to 400 nm which does not cause static marks, deterioration of color reproduction, and fading or discoloration of color images caused by ultraviolet rays.

A still further object of the present invention is to provide a silver halide color photographic light-sensitive material containing a novel ultraviolet ray absorbing polymer latex which does not have a bad influence upon photographic properties such as sensitivity or fog, etc.

Other objects of the present invention will be apparent from the following detailed description and examples.

As a result of extensive investigations, it has now been found that these objects of the present invention are attained by using at least one compound capable of reacting with and fixing formaldehyde gas represented by the general formula (I) or (II) described below which is loaded into an ultraviolet ray absorbing polymer latex composed of a polymer or a copolymer having a repeating unit derived from at least one monomer represented by the general formula (III) described below.

More specifically, it has been found that these objects can be attained by a silver halide color photographic light-sensitive material comprising a support having thereon at least one light-sensitive silver halide emulsion layer and at least one light-insensitive layer, the color photographic light-sensitive material containing in at least one layer selected from the light-sensitive silver halide emulsion layer and the light-insensitive layer, at least one compound capable of reacting with and fixing formaldehyde gas represented by the following general formula (I) or (II):

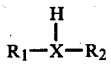

(I)

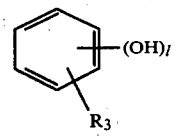

(II)

wherein $R_1$ and $R_2$, which may be the same or different, each represents an alkyl group having from 1 to 40 carbon atoms (for example, a methyl group, an n-butyl group, a tert-octyl group, an n-dodecyl group, an ethoxypropyl group or a benzyl group, etc.), an aryl group having from 6 to 40 carbon atoms (for example, a phenyl group, a tolyl group, a 2,4-di-tert-amylphenyl group or a chlorophenyl group, etc.), an acyl group having from 2 to 40 carbon atoms (for example, an acetyl group, a propionyl group, a pivaloyl group, a palmitoyl group, an oleoyl group or a benzoyl group, etc.), an alkoxycarbonyl group having from 3 to 40 carbon atoms (for example, an ethoxycarbonyl group, an n-octyloxycarbonyl group or a phenoxycarbonyl group, etc.), a carbamoyl group having from 2 to 40 carbon atoms (for example, an n-octylcarbamoyl group or a 2,4-di-tert-butylphenylcarbamoyl group, etc.) or an amino group, or $R_1$ and $R_2$ may form a ring or a dimer and at least one of $R_1$ and $R_2$ represents the acyl group, the alkoxycarbonyl group, the carbamoyl group or the amino group as defined above; X represents

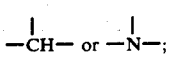

$R_3$ represents an alkyl group having from 1 to 20 carbon atoms (for example, a methyl group, an ethyl group, a tert-butyl group, a tert-octyl group or an n-pentadecyl group, etc.) or an aryl group having from 6 to 20 carbon atoms (for example, a phenyl group, a tolyl group or a chlorophenyl group, etc.), or may be bonded to the benzene ring to form a dicyclic ring; and l represents an integer of not less than 2, and the compound capable of reacting with and fixing formaldehyde gas is loaded into an ultraviolet ray absorbing polymer latex which comprises a polymer or a copolymer having a repeating unit derived from at least one monomer represented by the following general formula (III):

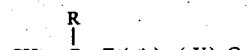

(III)

wherein R represents a hydrogen atom, a lower alkyl group having from 1 to 4 carbon atoms (for example, a methyl group, an ethyl group, an n-propyl group, an isopropyl group or an n-butyl group, etc.) or a chlorine atom; Z represents —CONH—, —COO— or a phenylene group; A represents a linking group selected from an alkylene group having from 1 to 20 carbon atoms (for example, a methylene group, an ethylene group, a trimethylene group, a 2-hydroxytrimethylene group, a pentamethylene group, a hexamethylene group, an ethylethylene group or a decamethylene group, etc.) and an arylene group having from 6 to 20 carbon atoms (for example, a phenylene group, etc.); Y represents —COO—, —OCO—, —CONH—, —NHCO—, $—SO_2NH—$, $—NHSO_2—$, $—SO_2—$ or —O—; m represents 0 or an integer of 1; n represents 0 or an integer of 1; and Q represents an ultraviolet ray absorbing group represented by the following general formula (IV):

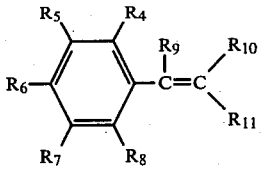

(IV)

wherein $R_4$, $R_5$, $R_6$, $R_7$ and $R_8$, which may be the same or different, each represents a hydrogen atom, a halogen atom (for example, a chlorine atom or a bromine atom, etc.), an alkyl group having from 1 to 20 carbon atoms (for example, a methyl group, an ethyl group, an n-propyl group, an isopropyl group, an n-butyl group, a tert-butyl group, an n-amyl group, a tert-amyl group, an n-octyl group, a tert-octyl group, a methoxyethyl group, an ethoxypropyl group, a hydroxyethyl group, a chloropropyl group, a benzyl group or a cyanoethyl group, etc.), an aryl group having from 6 to 20 carbon atoms (for example, a phenyl group, a tolyl group, a mesityl group, a chlorophenyl group, etc.), an alkoxy group having from 1 to 20 carbon atoms (for example, a methoxy group, an ethoxy group, a propoxy group, a butoxy group, an octyloxy group, a 2-ethylhexyloxy group, a methoxymethoxy group, a methoxyethoxy group or an ethoxyethoxy group, etc.), an aryloxy group having from 6 to 20 carbon atoms (for example, a phenoxy group or a 4-methylphenoxy group, etc.), an alkylthio group having from 1 to 20 carbon atoms (for example, a methylthio group, an ethylthio group, a propylthio group or an n-octylthio group, etc.), an arylthio group having from 6 to 20 carbon atoms (for example, a phenylthio group, etc.), an amino group, an alkylamino group having from 1 to 20 carbon atoms (for example, a methylamino group, an ethylamino group, a benzylamino group, a dimethylamino group or a diethylamino group, etc.), an arylamino group having from 6 to 20 carbon atoms (for example, an anilino group, a diphenylamino group, an anisidino group or a toluidino group, etc.), a hydroxy group, a cyano group, a nitro group, an acylamino group (for example, an acetylamino group, etc.), a carbamoyl group (for example, a methylcarbamoyl group or a dimethylcarbamoyl group, etc.), a sulfonyl group (for example, a methylsulfonyl group or a phenylsulfonyl group, etc.), a sulfamoyl group (for example, an ethylsulfamoyl group or a dimethylsulfamoyl group, etc.), a sulfonamido group (for example, a methanesulfonamido group, etc.), an acyloxy group (for example, an acetoxy group or a benzoyloxy group, etc.) or an oxycarbonyl group (for example, a methoxycarbonyl group, an ethoxycarbonyl group or a phenoxycarbonyl group, etc.), and $R_4$ and $R_5$, $R_5$ and $R_6$, $R_6$ and $R_7$ or $R_7$ and $R_8$ may form a 5- or 6-membered ring by ring closure (for example, a methylenedioxy group, etc.); $R_9$ represents a hydrogen atom, an alkyl group having from 1 to 20 carbon atoms (for example, a methyl group, an ethyl group, an n-propyl group, an isopropyl group, an n-butyl group, an n-amyl group or an n-octyl group, etc.) or an aryl group having from 6 to 20 carbon atoms; $R_{10}$ represents a cyano group, $—COOR_{12}$, $—CONHR_{12}$, $—COR_{12}$, or $—SO_2R_{12}$; $R_{11}$ represents a cyano group, $—COOR_{13}$, $—CONHR_{13}$, $—COR_{13}$ or $—SO_2R_{13}$; and $R_{12}$ and $R_{13}$ each represents the same alkyl group or an aryl group as described above. Further, at least one of $R_4$, $R_5$, $R_6$, $R_7$, $R_8$, $R_9$, $R_{10}$ and $R_{11}$ bonds to the vinyl group through the above-described linking group.

DETAILED DESCRIPTION OF THE INVENTION

Of the formalin scavengers represented by the general formula (I) or (II), compounds represented by the general formulae (I-1) to (I-9) and (II-1) and II-2) described below are preferred. They also include compounds which can be changed to enol forms on tautomerism.

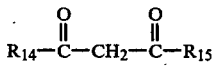
(I-1)

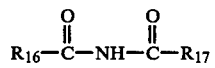
(I-2)

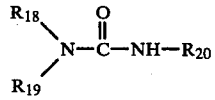
(I-3)

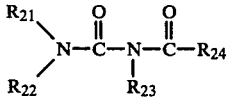
(I-4)

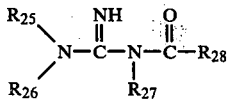
(I-5)

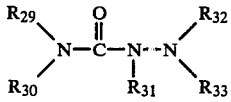
(I-6)

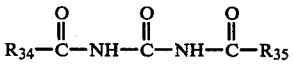
(I-7)

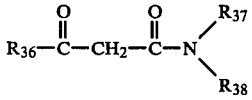
(I-8)

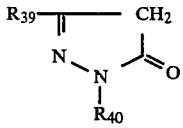
(I-9)

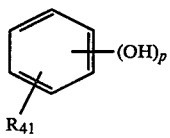
(II-1)

-continued

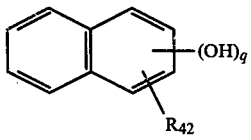
(II-2)

wherein $R_{14}$ to $R_{40}$ each represents a hydrogen atom, an alkyl group having from 1 to 40 carbon atoms (preferably from 1 to 20 carbon atoms), an aryl group having from 6 to 40 carbon atoms (preferably from 6 to 20 carbon atoms), an alkoxy group having from 1 to 40 carbon atoms (preferably from 1 to 20 carbon atoms) or a carbamoyl group having from 2 to 40 carbon atoms (preferably from 2 to 20 carbon atoms) and $R_{39}$ may be an arylamino group having 6 to 40 carbon atoms, and at least one of $R_{21}$, $R_{22}$ and $R_{23}$, at least one of $R_{25}$, $R_{26}$ and $R_{27}$ and at least one of $R_{29}$, $R_{30}$, $R_{31}$, $R_{32}$ and $R_{33}$ represents a hydrogen atom, or $R_{14}$ and $R_{15}$, $R_{16}$ and $R_{17}$, $R_{34}$ and $R_{35}$ may form a ring, and any two substituents selected from $R_{18}$ to $R_{20}$, from $R_{21}$ to $R_{24}$, from $R_{25}$ to $R_{28}$, from $R_{29}$ to $R_{33}$ and from $R_{36}$ to $R_{38}$ may form a ring; $R_{41}$ and $R_{42}$ each represents an alkyl group having from 1 to 20 (preferably from 1 to 8 carbon atoms) or an aryl group having from 6 to 20 carbon atoms (preferably from 1 to 14 carbon atoms); p represents an integer from 2 to 5; and q represents an integer of not less than 2.

Among these formalin scavengers, compounds represented by the general formulae (I-1), (I-2), (I-3), (I-4), (I-9) and (II-1) are more preferred. Compounds represented by the general formulae (I-2), (I-3) and (I-4) are particularly preferred.

Of the compounds represented by the general formula (III), those wherein R represents a hydrogen atom, a lower alkyl group having from 1 to 4 carbon atoms or a chlorine atom, Z represents —CONH—, —COO— or a phenyl group, A represents a linking group represented by an alkylene group having from 1 to 20 carbon atoms or an arylene group having from 6 to 20 carbon atoms, Y represents —COO—, —OCO—, —CONH—, —O—, m represents 0 or an integer of 1, n represents 0 or an integer of 1, and Q represents an ultraviolet ray absorbing group represented by the general formula (IV) wherein $R_4$, $R_5$, $R_6$, $R_7$ and $R_8$ each represents a hydrogen atom, a halogen atom, an alkyl group having from 1 to 20 carbon atoms, an aryl group having from 6 to 20 carbon atoms, an alkoxy group having from 1 to 20 carbon atoms, an aryloxy group having from 6 to 20 carbon atoms, an alkylamino group having from 1 to 20 carbon atoms, an arylamino group having from 6 to 20 carbon atoms, a hydroxy group, an acylamino group, a carbamoyl group, an acyloxy group or an oxycarbonyl group, and $R_4$ and $R_5$, $R_5$ and $R_6$, $R_6$ and $R_7$ or $R_7$ and $R_8$ may form a 5- or 6-membered ring by ring closure, $R_9$ represents a hydrogen atom or an alkyl group having from 1 to 20 carbon atoms, $R_{10}$ represents a cyano group, $—COOR_{12}$, $—CONHR_{12}$, $—COR_{12}$ or $—SO_2R_{12}$, $R_{11}$ represents a cyano group, $—COOR_{13}$, $—CONHR_{13}$, $—COR_{13}$ or $—SO_2R_{13}$, and $R_{12}$ and $R_{13}$ each represents an alkyl group having from 1 to 20 carbon atoms or an aryl group having from 6 to 20 carbon atoms, and further, at least one of $R_4$, $R_5$, $R_6$, $R_7$, $R_8$, $R_9$, $R_{10}$ and $R_{11}$ bonds to the vinyl group through the above-described linking group are preferred.

Examples of monomers (comonomers) used for copolymerizing with the ultraviolet ray absorbing monomer include an ester, preferably a lower alkyl ester, and an amide, derived from an acrylic acid, for example, acrylic acid, α-chloroacrylic acid, an α-alkylacrylic acid such as methacrylic acid, etc. (for example, acrylamide, methacrylamide, tert-butylacrylamide, methyl acrylate, methyl methacrylate, ethyl acrylate, ethyl methacrylate, n-propyl acrylate, n-butyl acrylate, 2-ethylhexyl acrylate, n-hexyl acrylate, octyl methacrylate, lauryl methacrylate and methylenebisacrylamide, etc.); a vinyl ester (for example, vinyl acetate, vinyl propionate and vinyl laurate, etc.); acrylonitrile; methacrylonitrile; an aromatic vinyl compound (for example, styrene and a derivative thereof such as vinyl toluene, divinylbenzene, vinylacetophenone, sulfostyrene and styrenesulfinic acid, etc.); itaconic acid; citraconic acid; crotonic acid; vinylidene chloride; a vinyl alkyl ether (for example, vinyl ethyl ether, etc.); an ester of maleic acid; N-vinyl-2-pyrrolidone; N-vinylpyridine; and 2- and 4-vinylpyridine, etc.

Of these monomers, an ester of acrylic acid, an ester of methacrylic acid and an aromatic vinyl compound are particularly preferred.

Two or more of the above-described comonomer compounds may be used together. For example, it is possible to use a combination of n-butyl acrylate and divinylbenzene, styrene and methyl methacrylate, methyl acrylate and methacrylic acid, etc.

The ethylenically unsaturated monomer which is used to copolymerize with the ultraviolet ray absorbing monomer corresponding to the above-described general formula (III) can be selected so as to have a good influence upon physical properties and/or chemical properties of the copolymer to be prepared, for example, solubility, compatibility with a binder such as gelatin in the photographic colloid composition or other photographic additives, for example, known photographic ultraviolet ray absorbing agents, known photographic antioxidants and known color image forming agents, flexibility and thermal stability thereof, etc.

The ultraviolet ray absorbing polymer latex used in the present invention may be prepared by an emulsion polymerization method or may be prepared by dissolving an oleophilic polymer ultraviolet ray absorbing agent obtained by polymerization of an ultraviolet ray absorbing monomer in an organic solvent and then dispersing the solution in a latex form in an aqueous solution of gelatin.

These methods can be applied to the preparation of homopolymers and the preparation of copolymers. In the latter case, the comonomer is preferably liquid, because it functions as a solvent for the ultraviolet ray absorbing monomer which is solid in a normal state when carrying out emulsion polymerization.

Free radical polymerization of an ethylenically unsaturated solid monomer is initiated with the addition to the monomer molecule of a free radical which is formed by thermal decomposition of a chemical initiator, an action of a reducing agent to an oxidizing compound (a redox initiator) or a physical action such a irradiation of ultraviolet rays or other high energy radiations, high frequencies, etc.

Examples of principal chemical initiators include a persulfate (for example, ammonium persulfate or potassium persulfate, etc.), hydrogen peroxide, a peroxide (for example, benzoyl peroxide or chlorobenzoyl peroxide, etc.) and an azonitrile compound (for example, 4,4'-azobis(4-cyanovaleric acid) and azobisisobutyronitrile, etc.), etc.

Examples of conventional redox initiators include hydrogen peroxide-iron (II) salt, potassium persulfate-potassium hydrogensulfate and cerium saltalcohol, etc.

Examples of the initiators and the functions thereof are described in F. A. Bovey, *Emulsion Polymerization,* issued by Interscience Publishers Inc., New York, 1955, pages 59–93.

As an emulsifier which can be used in the emulsion polymerization, a compound having surface activity is used. Preferred examples thereof include soap, a sulfonate, a sulfate, a cationic compound, an amphoteric compound and a high molecular weight protective colloid. Specific examples of the emulsifiers and the functions thereof are described in *Belgische Chemische Industrie,* Vol. 28, pages 16–20 (1963).

On the other hand, when dispersing the oleophilic polymer ultraviolet ray absorbing agent in an aqueous solution of gelatin in the form of a latex, an organic solvent used for dissolving the oleophilic polymer ultraviolet ray absorbing agent is removed from the mixture prior to coating of the dispersion or by volatilization during drying of the dispersion coated. Useful solvents include those which have a certain degree of water solubility so as to be capable of being removed by washing with water in a gelatin noodle state and those which can be removed by spray drying, vacuum or steam purging.

Further, examples of the organic solvents capable of being removed include an ester (for example, a lower alkyl ester, etc.), a lower alkyl ether, a ketone, a halogenated hydrocarbon (for example, methylene chloride, trichloroethylene, etc.), a fluorinated hydrocarbon, an alcohol (for example, an alcohol from n-butyl alcohol to octyl alcohol) and a combination thereof.

Any type of dispersing agent can be used in the dispersion of the oleophilic polymer ultraviolet ray absorbing agent. But ionic surface active agents, and particularly anionic surface active agents are preferred. Further, it is possible to use ampholytic surface active agents such as C-cetylbetaine, an N-alkylaminopropionate or an N-alkyliminodipropionate, etc.

In order to increase the dispersion stability and to improve the flexibility of the emulsion coated, a small amount (not more than 50% by weight of the ultraviolet ray absorbing polymer) of a permanent solvent, namely, a water-immiscible organic solvent having a high boiling point (i.e., above 200° C.) may be added. It is necessary for the concentration of the permanent solvent to be sufficiently low in order to plasticize the polymer while it is kept in a state of a solid particle. Furthermore, when using the permanent solvent, it is preferred that the amount thereof is as small as possible so as to decrease the thickness of the final emulsion layer in order to maintain good sharpness.

It is preferred that the proportion of the ultraviolet ray absorbing agent portion in the ultraviolet ray absorbing polymer latex according to the present invention is generally from 5% to 100% by weight, and the proportion of from 50% to 100% by weight is particularly preferred from the viewpoint of the thickness of the layer and stability.

In the following, typical examples of the compounds represented by the general formula (I), the compounds represented by the general formula (II) and the compounds represented by the general formula (III) according to the present invention are set forth, but the present invention is not to be construed as being limited thereto.
Compounds of the General Formula (I) or (II)
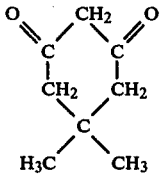
(S-1)
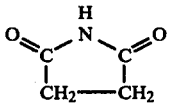
(S-2)
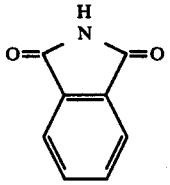
(S-3)
$NH_2CONHCH_2CH_2NHCONH_2$ (S-4)
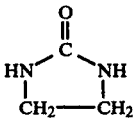
(S-5)
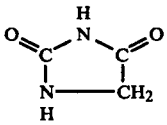
(S-6)
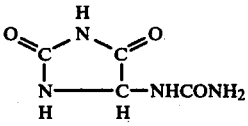
(S-7)
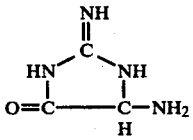
(S-8)
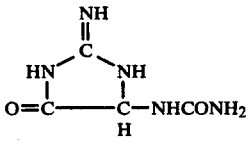
(S-9)
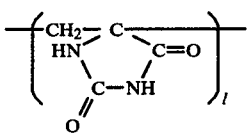
(S-10)
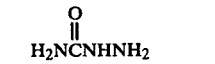
(S-11)
-continued
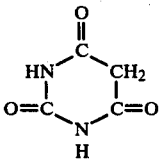
(S-12)
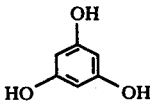
(S-13)
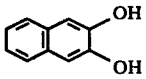
(S-14)
$CH_3CCH_2CCH_3$ (S-15)
$H_2NCNHCH_2NHCNH_2$ (S-16)
$H_2NCNH(CH_2)_3NHCNH_2$ (S-17)
$C_2H_5NHCNH_2$ (S-18)
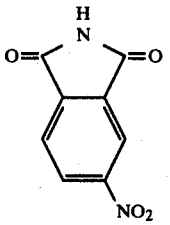
(S-19)
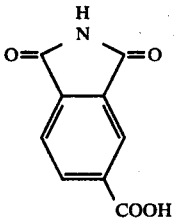
(S-20)
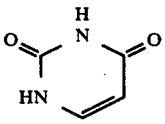
(S-21)
$CH_3CNHCNH_2$ (S-22)
$CH_3CNHC-NHCH_3$ (S-23)
$C_2H_5NHCNHNH_2$ (S-24)
$CH_3CONHCONHCOCH_3$ (S-25)
$H_5C_2-O-C-CH_2-C-O-C_2H_5$ (S-26)

-continued
(S-27)
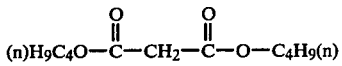
(S-28)
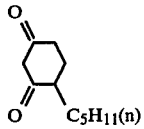
(S-29)
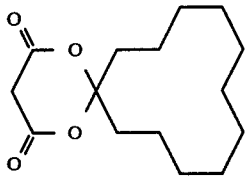
(S-30)
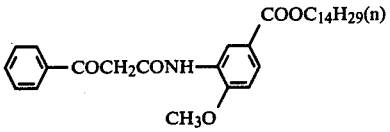
(S-31)
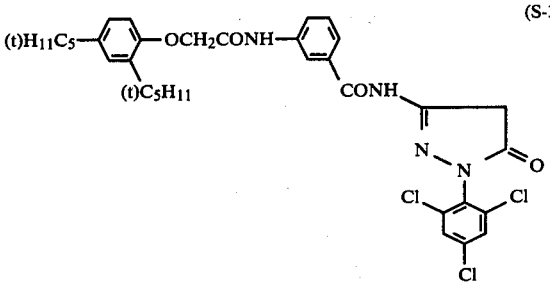
(S-32)
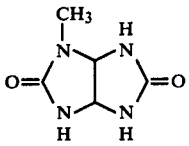
(S-33)
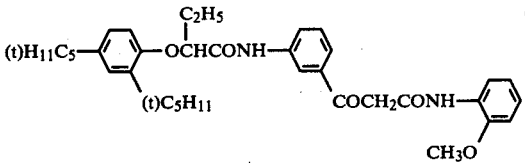
(S-34)
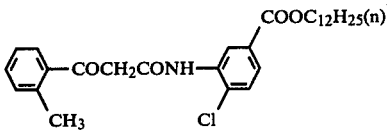
(S-35)
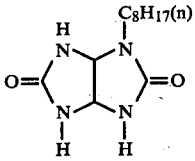
(S-36)
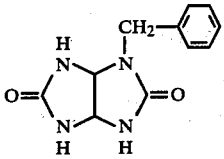
-continued
(S-37)
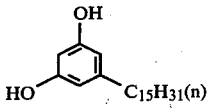
(S-38)
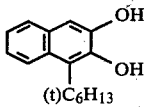
(S-39)
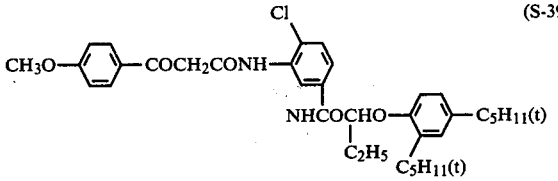
(S-40)
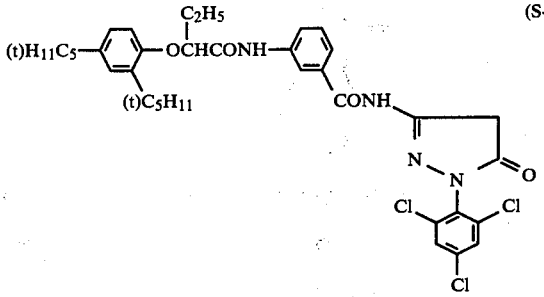
(S-41)
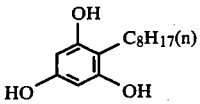
(S-42)
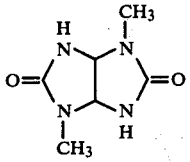
(S-43)
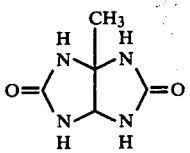
(S-44)
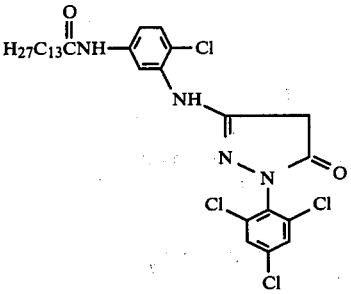
Compounds of the General Formula (III)
(III-1)
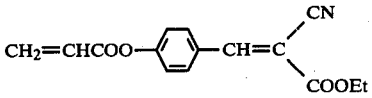

-continued (III-2)

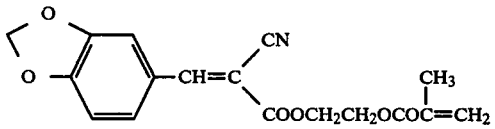

(III-3)

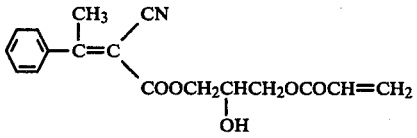

(III-4)

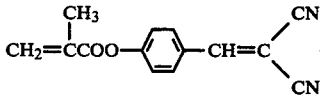

(III-5)

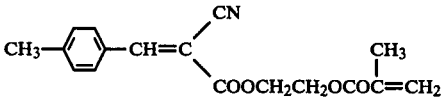

(III-6)

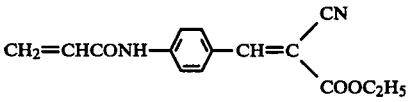

(III-7)

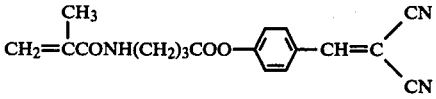

(III-8)

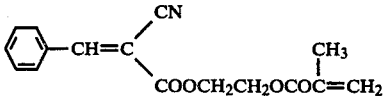

(III-9)

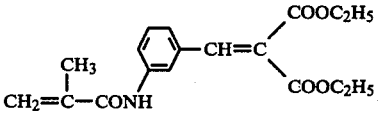

(III-10)

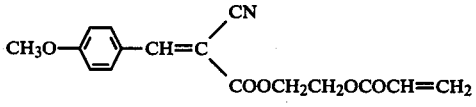

(III-11)

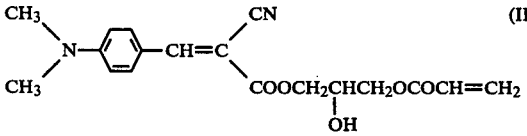

(III-12)

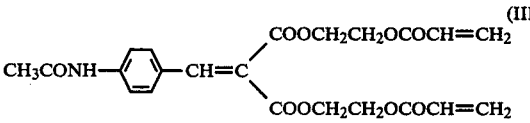

(III-13)

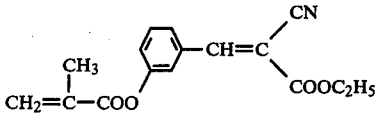

(III-14)

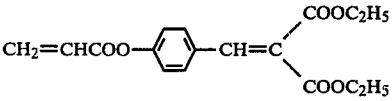

-continued (III-15)

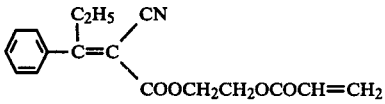

(III-16)

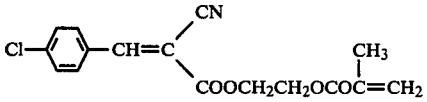

(III-17)

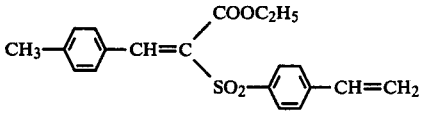

(III-18)

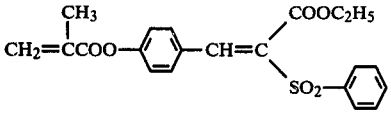

(III-19)

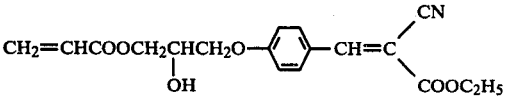

(III-20)

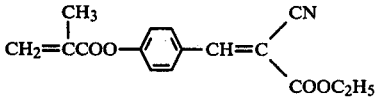

(III-21)

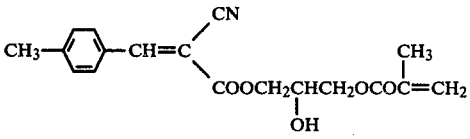

(III-22)

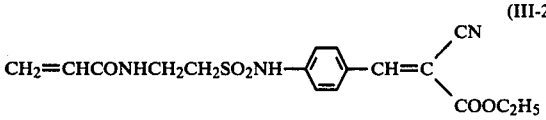

(III-23)

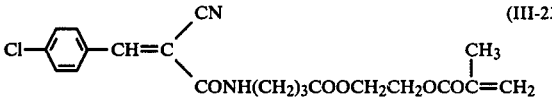

(III-24)

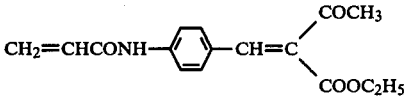

(III-25)

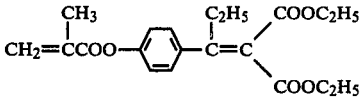

(III-26)

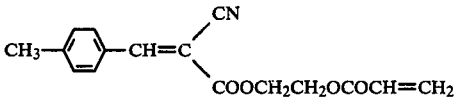

The compounds represented by the general formula (I) according to the present invention include those usually commercially available. Also, they can be synthesized according to the method as described, for example, in *Bulletin of the Chemical Society of Japan,* Vol. 39, pages 1559 to 1567 and 1734 to 1738 (1966), *Chem. Ber.,* Vol. 54B, pages 1802 to 1833 and 2441 to 2479

(1921), British Pat. No. 717,287, U.S. Pat. Nos. 2,731,472 and 3,187,004, H. Pauly, *Chem. Ber.*, Vol. 63B, page 2063 (1930), F. B. Slezak, *J. Org. Chem.*, Vol. 27, page 2181 (1962), J. Nematollahi, *J. Org. Chem.*, Vol. 28, page 2378 (1963), etc.

Preferred specific examples of the homopolymer or copolymer ultraviolet ray absorbing agents having a repeating unit derived from a monomer represented by the general formula (III) according to the present invention are set forth below, but the present invention is not to be construed as being limited thereto.

P-1 to P-26: Homopolymers of Compounds (III-1) to (III-26)

P-27: Copolymer of Compound (III-5):methyl methacrylate=7:3 (ratio by weight)

P-28: Copolymer of Compound (III-5):methyl methacrylate=5:5

P-29: Copolymer of Compound (III-5):methyl acrylate=7:3

P-30: Copolymer of Compound (III-8):styrene=5:5

P-31: Copolymer of Compound (III-8):butyl acrylate=2:1

P-32: Copolymer of Compound (III-1):methyl methacrylate=7:3

P-33: Copolymer of Compound (III-1):methyl methacrylate=5:5

P-34: Copolymer of Compound (III-8):methyl acrylate=7:3

P-35: Copolymer of Compound (III-2):methyl methacrylate=5:5

P-36: Copolymer of Compound (III-16):methyl methacrylate=7:3

P-37: Copolymer of Compound (III-16):methyl acrylate=5:5

Among these homopolymer or copolymer ultraviolet ray absorbing agents, P-1, P-5, P-8, P-10, P-20, P-27, P-28 and P-34 are more preferred. P-5, P-27, P-28 and P-34 are particularly preferred.

The ultraviolet ray absorbing monomers corresponding to the general formula (III) can be synthesized by reacting a compound synthesized by the process as described, for example, in U.S. Pat. No. 4,200,464, *Beilsteins Handbuch der Organischen Chemie*, 4th Edition, Vol. 10, page 521 (1942), etc., with acid halide of acrylic acid or α-substituted acrylic acid such as acryloyl chloride or methacryloyl chloride, and can also be synthesized by a reaction of 2-cyano-3-phenylacrylic acid with hydroxyethyl acrylate, hydroxyethyl methacrylate or glycidyl acrylate, etc., as described in Japanese Patent Application (OPI) No. 11102/73.

The ultraviolet ray absorbing polymer latex composed of a homopolymer or a copolymer having a repeating unit derived from at least one monomer represented by the general formula (III) in which at least one aldehyde scavenger represented by the general formula (I) or (II) is loaded according to the present invention can be prepared as follows. More specifically, at least one of the above-described aldehyde scavenger represented by the general formula (I) or (II) is loaded into at least one of the above-described ultraviolet ray absorbing polymer latexes previously prepared in the manner as described, for example, in Japanese Patent Application (OPI) Nos. 59943/76, 126830/81 and 56620/76, U.S. Pat. No. 4,195,999, etc., and the resulting latex can be used. Further, at least one of the above-described ultraviolet ray absorbing homopolymers or copolymers having a repeating unit derived from at least one monomer represented by the general formula (III) and at least one of the above-described aldehyde scavenger represented by the general formula (I) or (II) are dissolved in an organic solvent having a low boiling point or in a mixture composed of an organic solvent having a low boiling point and a small amount of an organic solvent having a high boiling point, the solution is emulsified in the manner as described, for example, in U.S. Pat. Nos. 3,533,794, 3,253,921 and 3,707,375, Japanese Patent Application (OPI) No. 56620/76, U.S. Pat. No. 4,195,999, etc., and the resulting latex can be used. The term "load" used herein refers to the state in which an aldehyde scavenger is incorporated into the interior of an ultraviolet ray absorbing polymer latex, or a state in which an aldehyde scavenger is deposited on the surface of an ultraviolet ray absorbing polymer latex. However, the mechanism by which the load occurs is not accurately known.

It is preferred that an amount of the aldehyde scavenger represented by the general formula (I) or (II) is from 50% to 300% by weight based on the amount of the homopolymer or copolymer having a repeating unit derived from a monomer represented by the general formula (III), and an amount of from 100% to 200% by weight is particularly preferred.

Specific synthesis examples of the monomer compounds represented by the general formula (III) and the polymer latexes formed therefrom are set forth below.

[A] Syntheses of Monomer Compounds

SYNTHESIS EXAMPLE I-1

Synthesis of Compound (III-5)

400 g of tolualdehyde, 311 g of cyanoacetic acid, 60 ml of acetic acid and 25.6 g of ammonium acetate were refluxed in 1.6 liters of ethyl alcohol for 4 hours with heating. After the reaction, the mixture was concentrated to 600 ml by removing the ethyl alcohol under a reduced pressure, followed by pouring into 1 liter of ice water to separate crystals. The separated crystals were collected by suction filtration and recrystallized from 2 liters of ethyl alcohol to obtain 560 g of 2-cyano-3-(4-methylphenyl)acrylic acid having a melting point of 210 to 215° C. 320 g of the resulting compound and 252 g of thionyl chloride were dissolved in 200 ml of acetonitrile with heating for 1 hour. After the reaction, the acetonitrile and the thionyl chloride were distilled off under a reduced pressure, and the resulting solid was added to a solution containing 244.8 g of hydroxyethyl methacrylate, 149 g of pyridine and 2 liters of acetonitrile. The reaction was carried out for 2 hours while maintaining the reaction temperature below 40° C. After the reaction, the reacting solution was poured into ice water to separate crystals, and the resulting crystals were recrystallized from 3 liters of ethyl alcohol to obtain 360 g of the desired compound having a melting point of 74° to 75° C. The identification of the compound was carried out using IR spectrum, NMR spectrum and elemental analysis.

| Elemental Analysis for $C_{17}H_{17}NO_4$ | H | C | N |
|---|---|---|---|
| Calculated (%) | 5.72 | 68.22 | 4.68 |
| Found (%) | 5.75 | 68.16 | 4.76 |
| $\lambda_{max}^{CH3OH}$ = 311 nm | | | |

SYNTHESIS EXAMPLE I-2

Synthesis of Compound (III-8)

200 g of benzaldehyde, 176 g of cyanoacetic acid, 30 ml of acetic acid and 14.5 g of ammonium acetate were refluxed for 4 hours in 800 ml of ethyl alcohol with heating. After the reaction, the mixture was concentrated to 400 ml by removing the ethyl alcohol under a reduced pressure, followed by pouring into 1 liter of ice water to separate crystals. The resulting crystals were recrystallized from 250 ml of acetonitrile to obtain 265 g of 2-cyano-3-phenylacrylic acid having a melting point of 184° to 188° C. 150 g of the resulting compound and 176 g of thionyl chloride were dissolved in 100 ml of acetonitrile with heating for 1 hour. After the reaction, the acetonitrile and the thionyl chloride were distilled off under a reduced pressure, and the resulting solid was added to a solution containing 124 g of hydroxyethyl methacrylate, 75 g of pyridine and 1 liter of acetonitrile. The reaction was carried out for 2 hours while maintaining the reaction temperature below 40° C. After the reaction, the reacting solution was poured into ice water to separate crystals, and the resulting crystals were recrystallized from 1 liter of ethyl alcohol to obtain 205 g of the desired compound having a melting point of 68° to 70° C. The identification of the compound was carried out using IR spectrum, NMR spectrum and elemental analysis.

| Elemental Analysis for $C_{16}H_{14}NO_4$ | H | C | N |
|---|---|---|---|
| Calculated (%) | 4.96 | 67.60 | 4.93 |
| Found (%) | 4.87 | 67.65 | 4.99 |
| $\lambda_{max}^{CH3OH}$ = 298 nm | | | |

SYNTHESIS EXAMPLE I-3

Synthesis of Compound (III-1)

30 g of 4-hydroxybenzaldehyde, 31.7 g of ethyl cyanoacetate, 4.5 ml of acetic acid and 1.9 g of ammonium acetate were refluxed in 100 ml of ethyl alcohol for 4 hours with heating. After the reaction, the reaction solution was poured into 500 ml of ice water to separate crystals. The resulting crystals were recrystallized from 400 ml of methyl alcohol to obtain 65 g of ethyl 2-cyano-3-(4-hydroxyphenyl)acrylate having a melting point of 89° to 91° C. 10.9 g of the resulting compound and 4.3 g of pyridine were dissolved in 100 ml of tetrahydrofuran, and 4.5 g of acryloyl chloride was added dropwise thereto. The reaction was carried out for 2 hours while maintaining the reaction temperature below 40° C. After the reaction, the reacting solution was poured into ice water to separate crystals, and the resulting crystals were recrystallized from 100 ml of methyl alcohol to obtain 11 g of the desired compound having a melting point of 82° to 85° C. The identification of the compound was carried out using IR spectrum, NMR spectrum and elemental analysis.

| Elemental Analysis for $C_{15}H_{13}NO_4$ | H | C | N |
|---|---|---|---|
| Calculated (%) | 4.83 | 66.41 | 5.16 |
| Found (%) | 4.91 | 66.42 | 5.08 |
| $\lambda_{max}^{CH3OH}$ = 323 nm | | | |

SYNTHESIS EXAMPLE I-4

Synthesis of Compound (III-21)

9.4 g of 2-cyano-3-(4-methylphenyl)acrylic acid obtained by the process described in Synthesis Example I-1, 7.1 g of glycidyl methacrylate and 2.5 g of triethylamine were refluxed for 5 hours in 120 ml of methyl ethyl ketone with heating. After the reaction, the methyl ethyl ketone was distilled off under a reduced pressure, and the residue was subjected to column chromatography (Kieselgel 60, manufactured by Merck Co.) to collect ethyl acetate/hexane effluent. When recrystallization was carried out from methyl alcohol 7 g of the desired compound having a melting point of 52° to 53° C. was obtained. The identification of the compound was carried out using IR spectrum, NMR spectrum and elemental analysis.

| Elemental Analysis for $C_{18}H_{19}NO_5$ | H | C | N |
|---|---|---|---|
| Calculated (%) | 5.81 | 65.64 | 4.25 |
| Found (%) | 5.90 | 65.52 | 4.30 |
| $\lambda_{max}^{CH3OH}$ = 311 nm | | | |

[B] Syntheses of Polymer Latexes

SYNTHESIS EXAMPLE II-1

Synthesis of Homopolymer Latex of Compound (III-5)

800 ml of an aqueous solution containing 10 g of sodium salt of oleylmethyltauride dissolved was heated to 90° C. while gradually introducing nitrogen gas therethrough under stirring. To the resulting mixture, 20 ml of an aqueous solution containing 350 mg of potassium persulfate was added. Then, a solution prepared by dissolving 50 g of Ultraviolet Ray Absorbing Monomer (III-5) in 300 ml of ethyl alcohol by heating was added thereto. After the completion of the addition, the mixture was stirred for 1 hour while heating at 80° to 90° C., and 10 ml of an aqueous solution containing 150 mg of potassium persulfate was added thereto. After the reaction was further carried out for 1 hour, the ethyl alcohol was distilled off as an azeotropic mixture with water. The latex thus formed was cooled. After the pH was adjusted to 6.0 with a 1 N sodium hydroxide solution, the latex was filtered to obtain Latex (P-5). The concentration of the solid component in the latex was 6.42%. Further, the latex had the absorption maximum at 325 nm in the aqueous system.

SYNTHESIS EXAMPLE II-2

Synthesis of Copolymer Latex of Compound (III-8) and n-Butyl Acrylate

1 Liter of an aqueous solution containing 15 g of sodium salt of oleylmethyltauride dissolved was heated to 90° C. while gradually introducing nitrogen gas therethrough under stirring. To the resulting mixture, 20 ml of an aqueous solution containing 525 mg of potassium persulfate was added. Then, 50 g of Ultraviolet Ray Absorbing Monomer (III-8) and 25 g of n-butyl acrylate were dissolved in 200 ml of ethanol with heating, and the resulting solution was added to the mixture. After the completion of the addition, the mixture was stirred for 1 hour with heating at 80° to 90° C., and 10 ml of an aqueous solution containing 225 mg of potassium persulfate was added thereto. After the reaction was further carried out for 1 hour, the ethanol and the n-butyl acrylate not reacted were distilled off as an azeotropic mixture with water. The latex thus formed was cooled. After the pH was adjusted to 6.0 with a 1 N sodium hydroxide solution, the latex was filtered to obtain Latex (P-31). The concentration of the solid component in the latex was 7.71%. Further, the latex had the absorption maximum at 315 nm in the aqueous system.

SYNTHESIS EXAMPLE II-3

Synthesis of Copolymer Latex of Compound (III-5) and Methyl Methacrylate

4 Liters of an aqueous solution containing 75 g of sodium salt of oleylmethyltauride dissolved was heated to 90° C. while gradually introducing nitrogen gas therethrough under stirring. To the resulting mixture, 50 ml of an aqueous solution containing 2.6 g of potassium persulfate was added. Then, 200 g of Ultraviolet Ray Absorbing Monomer (III-5) and 200 g of methyl methacrylate were dissolved in 1 liter of ethanol, and the resulting solution was added to the mixture. After the completion of the addition, the mixture was stirred for 1 hour while heating at 80° to 90° C., and 20 ml of an aqueous solution containing 1.1 g of potassium persulfate was added thereto. After the reaction was further carried out for 1 hour, the ethanol and the methyl methacrylate not reacted were distilled off as an azeotropic mixture with water. The latex thus formed was cooled. After the pH was adjusted to 6.0 with a 1 N sodium hydroxide solution, the latex was filtered to obtain Latex (P-28). The concentration of the solid component in the latex was 9.26%. Further, the latex had the absorption maximum at 328 nm in the aqueous system.

SYNTHESIS EXAMPLE II-4

Synthesis of Oleophilic Polymer Ultraviolet Ray Absorbing Agent (P-34)

21 g of Ultraviolet Ray Absorbing Monomer (III-8) and 9 g of methyl acrylate were dissolved in 150 ml of dioxane. While stirring the resulting solution with heating at 70° C. under nitrogen atmosphere, a solution prepared by dissolving 270 mg of 2,2'-azobis-(2,4-dimethylvaleronitrile) in 5 ml of dioxane was added, and the reaction was carried out for 5 hours. Then, the resulting product was poured into 2 liters of ice water, and the solid thus separated was collected by filtration and thoroughly washed with water. The product was dried to obtain 25.3 g of Oleophilic Polymer Ultraviolet Ray Absorbing Agent (P-34). As the result of nitrogen analysis of the oleophilic polymer ultraviolet ray absorbing agent, it was found that the copolymer synthesized contained 64.5% of the ultraviolet ray absorbing monomer unit.

$$\lambda_{max}^{CH_3COOC_2H_5} = 300 \text{ nm}$$

SYNTHESIS EXAMPLE II-5

Synthesis of Oleophilic Polymer Ultraviolet Ray Absorbing Agent (P-27)

63 g of Ultraviolet Ray Absorbing Monomer (III-5) and 27 g of methyl methacrylate were dissolved in 450 ml of dioxane. While stirring the resulting solution with heating at 70° C. under nitrogen atmosphere, a solution prepared by dissolving 810 mg of 2,2'-azobis-(2,4-dimethylvaleronitrile) in 15 ml of dioxane was added, and the reaction was carried out for 5 hours. Then, the resulting product was poured into 5 liters of ice water, and the solid thus separated was collected by filtration and thoroughly washed with water and then methanol. The product was dried to obtain 78 g of Oleophilic Polymer Ultraviolet Ray Absorbing Agent (P-27). As the result of nitrogen analysis of the oleophilic polymer ultraviolet ray absorbing agent, it was found that the copolymer synthesized contained 63.3% of the ultraviolet ray absorbing monomer unit.

$$\lambda_{max}^{CH_3COOC_2H_5} = 315 \text{ nm}$$

The aldehyde scavenger which is loaded into the ultraviolet ray absorbing polymer latex according to the present invention is used by adding it to a hydrophilic colloid layer of the silver halide color photographic light-sensitive materials, such as a surface protective layer, an intermediate layer or a silver halide emulsion layer, a subbing layer, etc. It is preferred to use it in the surface protective layer or a hydrophilic colloid layer adjacent to the surface protective layer, in order to effectively exhibit the characteristics of the ultraviolet ray absorbing compound and the aldehyde scavenger. Particularly, it is preferable to add it to the lower layer in the surface protective layer consisting of two layers.

The amount of the ultraviolet ray absorbing polymer latex used in the present invention is generally in a range of from 10 mg to 4,000 mg per square meter and preferably from 50 mg to 2,000 mg per square meter. The amount of the aldehyde scavenger used in the present invention is generally in a range of from 10 mg to 10,000 mg per square meter and preferably from 50 mg to 5,000 mg per square meter.

Examples of silver halide color photographic light-sensitive materials to which the present invention can be applied include color negative films, color reversal films, color papers and light-sensitive materials for color diffusion transfer processes, etc.

By loading the aldehyde scavenger represented by the general formula (I) or (II) into the ultraviolet ray absorbing polymer latex having a repeating unit derived from a monomer represented by the general formula (III) in accordance with the present invention, it is possible to prevent the influence of ultraviolet rays and formalin, and the remarkable effects as described above can be achieved without using an organic solvent having a high boiling point.

Further, in the present invention it is not necessary to use a superfluous polymer latex which is employed only for the purpose of loading a formalin scavenger because the polymer latex according to the present invention in which the formalin scavenger is loaded has also the function of ultraviolet ray absorbing agent. Therefore, it is possible to reduce the thickness of the photographic layer which is extremely advantageous.

Moreover, when ultraviolet ray absorbing agents are polymerized, it is usually observed that the ultraviolet ray absorbing characteristics are adversely affected, i.e., the absorption becomes broad, and thus the sensitivity in a visible range of a blue-sensitive layer of color photographic light-sensitive materials is remarkably decreased. On the contrary, the ultraviolet ray absorbing polymer latex used in the present invention does not have these problems which is one of the great advantages according to the present invention.

Therefore, the silver halide color photographic light-sensitive material according to the present invention has sufficient film strength when a formalin scavenger is added thereto in an amount sufficient for improving the formalin resistivity. The photographic light-sensitive material is also advantageous in the photographic properties, for example, the improvement in sharpness, no reduction in the sensitivity in a visible range. Further, it is extremely improved with respect to the occurrence of static marks, the deterioration of color reproduction and the fading or discoloration of color images.

The photographic emulsion layers in the photographic light-sensitive material of the present invention may contain color forming couplers, namely, compounds capable of color forming by an oxidation coupling reaction with the aromatic primary amine developing agent (for example, phenylenediamine derivatives, aminophenol derivatives, etc.) in the color development processing. For example, magenta couplers such as 5-pyrazolone couplers, pyrazolobenzimidazole couplers, cyanoacetyl coumarone couplers, ring-opened acylacetonitrile couplers, etc.; yellow couplers such as acylacetamide couplers (for example, benzoylacetanilides and pivaloylacetanilides), etc.; and cyan couplers such as naphthol couplers, phenol couplers, etc. It is preferred that these couplers have a hydrophobic group which is called a ballast group in the molecule, or are non-diffusible due to their polymeric structure. The couplers may be 2-equivalent or 4-equivalent to silver ion. Further, the couplers may be colored couplers having a function of color correction or couplers which release a development inhibitor with development (the so-called DIR couplers).

Further, the emulsion layers may contain non-color forming DIR coupling compounds other than DIR couplers which release a development inhibitor, the product of which, formed by a coupling reaction, is colorless.

The emulsion layers may contain non-color forming couplers, the product of which, formed by a coupling reaction, is colorless; infrared couplers which form a dye having an infrared absorption by a coupling reaction; and black color forming couplers which form black images by a coupling reaction, etc., other than the above-described couplers. Furthermore, the emulsion layers may contain couplers which release a development accelerator with development as described in Japanese Patent Application (OPI) No. 150845/82.

Specific examples of the magenta couplers include those described in U.S. Pat. Nos. 2,600,788, 2,983,608, 3,062,653, 3,127,267, 3,311,476, 3,419,391, 3,519,429, 3,558,319, 3,582,322, 3,615,506, 3,834,908, 3,891,445, 3,926,631, 3,928,044, 4,076,533, 4,189,321, 4,220,470, 4,264,723 and 4,248,961, German Pat. No. 1,810,464, German Patent Application (OLS) Nos. 2,408,665, 2,417,945, 2,418,949, 2,424,467, 2,536,191, 2,651,363, 2,935,848 and 2,944,601, Japanese Patent Publication Nos. 6031/65, 38498/79, 10901/80, 29420/80 and 29421/80, and Japanese Patent Application (OPI) Nos. 74027/74, 129538/74, 60233/75, 159336/75, 20826/76, 26541/76, 36938/76, 105820/76, 42121/77, 58922/77, 9122/78, 55122/78, 48540/79, 80744/79, 62454/80, 118034/80, 38043/81, 38044/81, 75648/81, 126833/81 and 17950/82, etc.

Specific examples of the yellow couplers include those described in U.S. Pat. Nos. 2,875,057, 3,265,506, 3,408,194, 3,551,155, 3,582,322, 3,725,072, 3,891,445, 3,894,875, 3,973,968, 3,990,896, 4,008,086, 4,012,259, 4,022,620, 4,029,508, 4,046,575, 4,057,432, 4,059,447, 4,095,983, 4,133,958, 4,157,919, 4,182,630, 4,186,019, 4,203,768, 4,206,278 and 4,266,019, German Pat. No. 1,547,868, German Patent Application (OLS) Nos. 2,213,461, 2,219,917, 2,261,361, 2,263,875, 2,414,006, 2,528,638, 2,935,849 and 2,936,842, British Pat. No. 1,425,020, Japanese Patent Publication Nos. 13576/74, 10783/76, 36856/79 and 13023/80, Japanese Patent Application (OPI) Nos. 26133/72, 66835/73, 6341/75, 34232/75, 87650/75, 130442/75, 75521/76, 102636/76, 145319/76, 21827/76, 82424/77, 115219/77, 48541/79, 121126/79, 2300/80, 36900/80, 38576/80, 70841/80, 161239/80 and 87041/81, Research Disclosure, No. 18053, etc.

Specific examples of the cyan couplers include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,758,308, 3,767,411, 4,004,929, 4,052,212, 4,124,396, 4,146,396, 5,205,990, 4,228,233, 4,254,212 and 4,264,722, German Patent Application (OLS) Nos. 2,214,489, 2,414,830, 2,454,329, 2,634,694, 2,841,166, 2,934,769, 2,945,813, 2,947,707 and 3,005,355, Japanese Patent Publication Nos. 37822/79 and 37823/79, and Japanese Patent Application (OPI) Nos. 5055/73, 59838/73, 130441/75, 26034/76, 146828/76, 69624/77, 90932/77, 52423/78, 105226/78, 110530/78, 14736/79, 48237/79, 66129/79, 131931/79, 32071/80, 65957/80, 73050/80, 108662/80, 1938/81, 12643/81, 55945/81, 65134/81 and 80045/81, etc.

Specific examples of the colored couplers include those described in U.S. Pat. Nos. 2,521,908, 3,034,892 and 3,476,560, German Patent Application (OLS) No. 2,418,959, Japanese Patent Publication Nos. 22335/63, 11304/67, 2016/69 and 32461/69, and Japanese Patent Application (OPI) Nos. 26034/76, 42121/77, etc.

Specifie examples of the DIR couplers include those described in U.S. Pat. Nos. 3,227,554, 3,617,291, 3,632,345, 3,701,783, 3,790,384, 3,933,500, 3,938,996, 4,052,213, 4,157,916, 4,171,223, 4,183,752, 4,187,110 and 4,226,934, German Patent Application (OLS) Nos. 2,414,006, 2,454,301, 2,454,329, 2,540,959, 2,707,489, 2,709,688, 2,730,824, 2,754,281, 2,835,073, 2,853,363, 2,855,697 and 2,902,681, British Pat. No. 953,454, Japanese Patent Publication Nos. 16141/76, 2776/78, 34933/80 and 47379/80, Japanese Patent Application (OPI) Nos. 122335/74, 69624/77, 154631/77, 7232/78, 9116/78, 15136/78, 20324/78, 29717/78, 13533/78, 143223/78, 73033/79, 114241/79, 115229/79, 145135/79, 84935/80, 135835/80 and 151944/82, *Research Disclosure,* No. 18104, etc.

In addition to DIR couplers, the light-sensitive materials may contain compounds which release a development inhibitor with development, specific examples of which include those described in U.S. Pat. Nos. 3,297,445 and 3,379,529, German Patent Application (OLS) No. 2,417,914, Japanese Patent Application (OPI) Nos. 15271/77 and 9116/78, etc.

Specific examples of the non-color forming couplers include those described in U.S. Pat. Nos. 3,912,513 and 4,204,867, Japanese Patent Application (OPI) No. 152721/77, etc.

Specific examples of the infrared couplers include those described in U.S. Pat. No. 4,178,183, Japanese Patent Application (OPI) No. 129036/78, and *Research Disclosure,* No. 13460 and No. 18732, etc.

Specific examples of the black color forming couplers include those described in U.S. Pat. Nos. 4,126,461, 4,137,080 and 4,200,466, Japanese Patent Application (OPI) Nos. 46029/78, 133432/78, 105247/80 and 105248/80, etc.

The emulsion layers in the photographic light-sensitive materials of the present invention may contain polymeric couplers. Specific examples of these couplers include those described in U.S. Pat. Nos. 2,698,797, 2,759,816, 2,852,381, 3,163,625, 3,208,977, 3,211,552, 3,299,013, 3,370,952, 3,424,583, 3,451,820, 3,515,557, 3,767,412, 3,912,513, 3,926,436, 4,080,211, 4,128,427 and 4,215,195, *Research Disclosure,* No. 17825, No. 18815 and No. 19033, etc.

It has been found that the compound according to the present invention exhibits particularly remarkable improved effects in the photographic light-sensitive material containing a 4-equivalent magenta coupler.

The 4-equivalent magenta couplers which can be preferably used in the present invention include not only the so-called oil-soluble magenta couplers containing a hydrophobic group but also the so-called Fisher type magenta couplers containing both a hydrophobic group and a hydrophilic group and magenta polymer coupler latexes described hereinafter.

Specific examples of the oil-soluble magenta couplers are set forth below, but the present invention is not to be construed as being limited thereto.

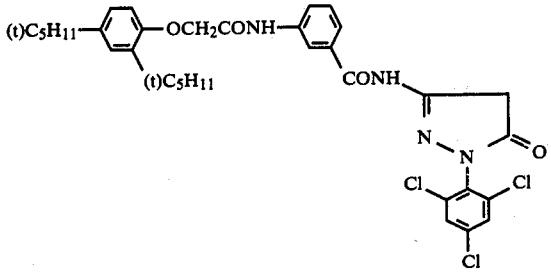

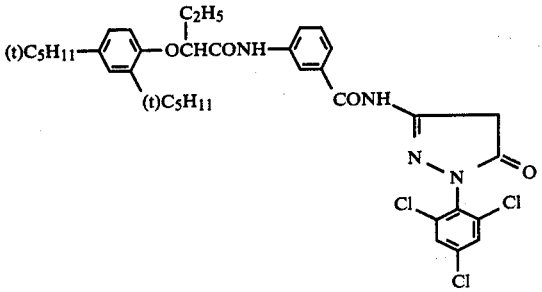

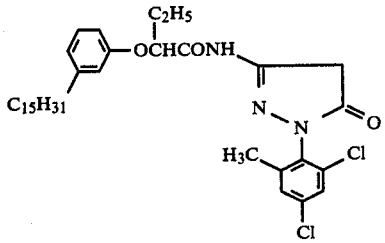

-continued

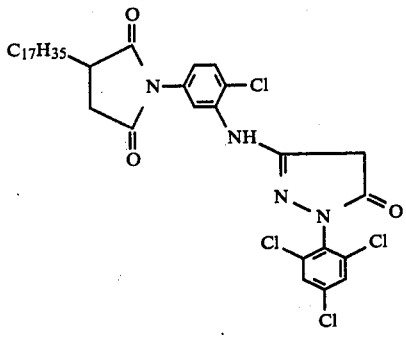

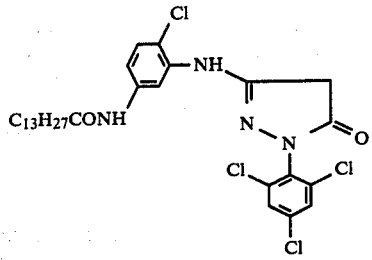

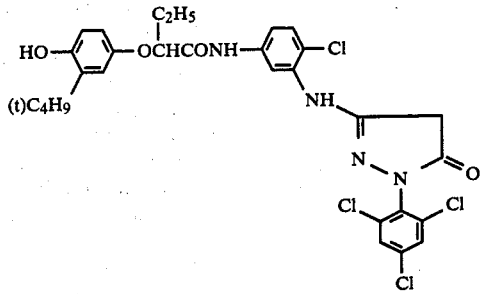

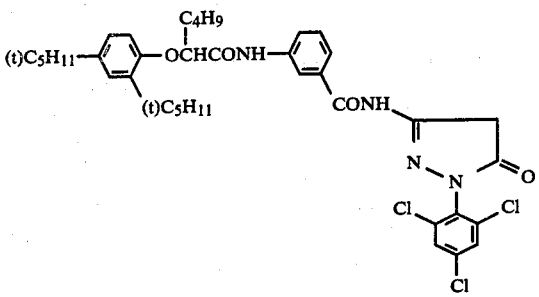

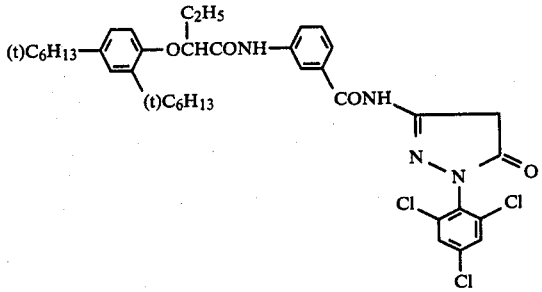

-continued

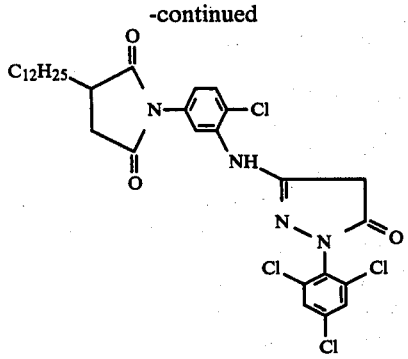

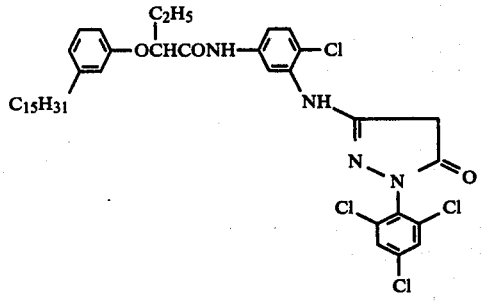

The 4-equivalent magenta color image forming polymer coupler latex which can be used in the present invention is preferably a polymer having a repeating unit derived from a monomer coupler represented by the general formula (V) described below, or a copolymer of a repeating unit derived from a monomer coupler represented by the general formula (V) described below and at least one non-color forming monomer having at least one ethylene group which does not have the ability to carry out oxidative coupling with an aromatic primary amine developing agent.

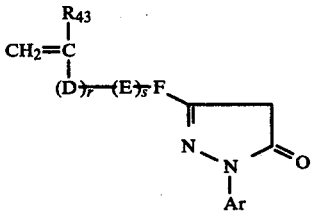

(V)

wherein $R_{43}$ represents a hydrogen atom, a lower alkyl group containing from 1 to 4 carbon atoms or a chlorine atom; F represents —CONH—, —NH—, —NHCONH— or —NHCOO—; D represents —CONH— or —COO—; E represents a divalent connecting group which is composed from one or more groups selected from an alkylene group having from 1 to 10 carbon atoms which may be substituted, an alkenylene group which may be substituted, a phenylene group which may be substituted, —O—, —S—, —SO—, —$SO_2$—, —CO—, —NH—, —CONH— and —COO—. The alkylene group and the alkenylene group may be a straight chain or a branched chain. For example, a methylene group, a methylmethylene group, a dimethylmethylene group, a dimethylene group, a trimethylene group, a pentamethylene group, a decamethylene group, etc.

Substituents for the alkylene group, the alkenylene group or the phenylene group represented by E include an aryl group (for example, a phenyl group, etc.), a nitro group, a hydroxy group, a cyano group, a sulfo group, an alkoxy group (for example, a methoxy group, etc.), an aryloxy group (for example, a phenoxy group, etc.), an acyloxy group (for example, an acetoxy group, etc.), an acylamino group (for example, an acetylamino group, etc.), a sulfonamido group (for example, a methanesulfonamido group, etc.), a sulfamoyl group (for example, a methylsulfamoyl group, etc.), a halogen atom (for example, a fluorine atom, a chlorine atom, a bromine atom, etc.), a carboxy group, a carbamoyl group (for example, a methylcarbamoyl group, etc.), an alkoxycarbonyl group (for example, a methoxycarbonyl group, etc.), a sulfonyl group (for example, a methylsulfonyl group, etc.), and the like. When two or more substituents are present, they may be the same or different.

Ar represents an unsubstituted or substituted phenyl group. Substituents for the phenyl group include an alkyl group (for example, a methyl group, an ethyl group, etc.), an alkoxy group (for example, a methoxy group, an ethoxy group, a 2-chloro-1,1,2-trifluoroethoxy group, etc.), an aryloxy group (for example, a phenoxy group, etc.), an alkoxycarbonyl group (for example, a methoxycarbonyl group, etc.), an acylamino group (for example, an acetylamino group, etc.), a carbamoyl group, an alkylcarbamoyl group (for example, a methylcarbamoyl group, an ethylcarbamoyl group, etc.), a dialkylcarbamoyl group (for example, a dimethylcarbamoyl group, etc.), an arylcarbamoyl group (for example, a phenylcarbamoyl group, etc.), an alkylsulfonyl group (for example, a methylsulfonyl group, etc.), an arylsulfonyl group (for example, a phenylsulfonyl group, etc.), an alkylsulfonamido group (for example, a methanesulfonamido group, etc.), an arylsulfonamido group (for example, a phenylsulfonamido group, etc.), a sulfamoyl group, an alkylsulfamoyl group (for example, an ethylsulfamoyl group, etc.), a dialkylsulfamoyl group (for example, a dimethylsulfamoyl group, etc.), an alkylthio group (for example, a methylthio group, etc.), an arylthio group (for example, a phenylthio group, etc.), a cyano group, a nitro group, a halogen atom (for example, a fluorine atom, a chlorine atom, a bromine atom, etc.), and the like. When two or more substituents are present, they may be the same or different.

Particularly preferred substituents include a halogen atom, an alkyl group, an alkoxy group, an alkoxycarbonyl group and a cyano group.

r represents 0 or 1, and s represents 0 or 1.

Examples of the non-color forming monomer which does not couple with the oxidation product of an aromatic primary amine developing agent include an ester, preferably a lower alkyl ester and an amide, derived from an acrylic acid (for example, acrylic acid, α-chloroacrylic acid, α-alkylacrylic acid such as methacrylic acid), for example, acrylamide, methacrylamide, t-butylacrylamide, methyl acrylate, ethyl acrylate, n-propyl acrylate, n-butyl acrylate, 2-ethylhexyl acrylate, n-hexyl acrylate, octyl methacrylate, lauryl methacrylate, methylene bisacrylamide, etc.; a vinyl ester, for example, vinyl acetate, vinyl propionate, vinyl laurate, etc.; acrylonitrile; methacrylonitrile; an aromatic vinyl compound, for example, styrene and a derivative thereof, for example, vinyl toluene, divinyl benzene, vinyl acetophenone, sulfo styrene, etc.; itaconic acid; citraconic acid; crotonic acid; vinylidene chloride; a vinyl alkyl ether, for example, vinyl ethyl ether; an ester of maleic acid; N-vinyl-2-pyrrolidone; N-vinylpyridine; 2- or 4-vinylpyridine, etc.

Of these monomers, an ester of acrylic acid, an ester of methacrylic acid and an ester of maleic acid are particularly preferred.

Two or more comonomer compounds described above can be used together. For example, a combination of n-butyl acrylate and divinylbenzene, styrene and methacrylic acid, n-butyl acrylate and methacrylic acid, etc., can be used.

The ethylenically unsaturated monomer which is used to copolymerize with the monomer coupler represented by the above-described general formula (V) can be selected so that the copolymer to be formed possesses good physical properties and/or chemical properties, for example, solubility, compatibility with a binder such as gelatin in a photographic colloid composition, flexibility, heat stability, etc., and other well known properties in the field of polymer color couplers.

The magenta polymer coupler latex used in the present invention can be prepared by dissolving a lipophilic polymer coupler obtained by the polymerization of a monomer coupler in an organic solvent and then dispersing the solution in a latex form in an aqueous gelatin solution. This can be accomplished by directly dispersing a solution of a liphphilic polymer coupler obtained by the polymerization of a monomer coupler or by dissolving a solid lipophilic polymer coupler once collected in an organic solvent and then dispersing the solution in a latex form. Alternatively, a latex prepared by an emulsion polymerization method may be directly added to a gelatin silver halide emulsion.

With respect to the former case in which a lipophilic polymer coupler is dispersed in a latex form in an aqueous gelatin solution, the method is described in U.S. Pat. No. 3,451,820 can be used. With respect to the latter case in which a latex prepared by an emulsion polymerization method is directly added, the method as described in U.S. Pat. Nos. 4,080,211, 3,370,952, 3,926,436 and 3,767,412, and British Pat. No. 1,247,688 can be used.

These methods can be applied to a preparation of homopolymers and a preparation of copolymers. In the latter case, a non-color forming comonomer is preferably a liquid comonomer which may act, in the case of the emulsion polymerization, as a solvent for a monomer which is solid in its normal state.

The organic solvent which is used for dissolving a lipophilic polymer coupler when the lipophilic polymer coupler is dispersed in a latex form in an aqueous gelatin solution is removed from the mixture before coating with the dispersion solution. The solvent may also be removed by vaporization during drying of the dispersion solution coated. With respect to removing the solvent, a method in which the solvent is removed by washing a gelatin noodle with water is used when the solvent is water-soluble to some extent, or a spray drying method, a vacuum purging method or a steam purging method can be employed for removing the solvent.

Examples of the organic solvents which can be removed include, for example, an ester (for example, a lower alkyl ester, etc.), a lower alkyl ether, ketone, halogenated hydrocarbon (for example, methylene chloride, trichloroethylene, a fluorinated hydrocarbon, etc.), an alcohol (for example, an alcohol between n-butyl alcohol and octyl alcohol, etc.), and a mixture thereof.

Any type of dispersing agent can be used in the dispersion of the lipophilic polymer coupler. Ionic surface active agents, and particularly anionic surface active agents, are preferred. Amphoteric surface active agents such as C-cetyl betaine, an N-alkylaminopropionate, an N-alkyliminodipropionate, etc., can also be used.

The emulsifier used in the emulsion polymerization is a compound havine surface activity. Preferred examples include soap, a sulfonate, a sulfate, a cationic compound, an amphoteric compound and a high molecular weight protective colloid. Specific examples and functions of the emulsifiers are described in *Belgische Chemische Industrie,* Vol. 28, pages 16 to 20 (1963).

In order to increase the dispersion stability, control the color hue of a dye formed from a polymer coupler latex dispersed and the oxidation product of an aromatic primary amine developing agent and improve the bending property of the emulsion coated, a permanent solvent, that is, a water-immiscible organic solvent having a high boiling point (i.e., above 200° C.), may be added in a small amount (i.e., not more than 50% by weight based on the polymer coupler). The concentration of the permanent solvent must be at such a low level that the copolymer is plasticized while it is maintained in solid particle form. Furthermore, it is desirable to use the permanent solvent in a relatively low concentration in order to reduce the thickness of the final emulsion layer is much as possible to obtain good sharpness.

It is desirable if the proportion of the color forming portion of the polymer coupler latex is usually from 5 to 80% by weight. Particularly, the proportion from 20 to 70% by weight is preferred in view of color reproducibility, color forming property and stability. In this case, an equivalent molecular weight, that is, a gram number of the polymer containing 1 mol of a coupler monomer is preferably from about 250 to 3,000, but it is not limited thereto.

Preferred specific examples of the monomer couplers used in the present invention are set forth below, but the present invention is not to be construed as being limited thereto.

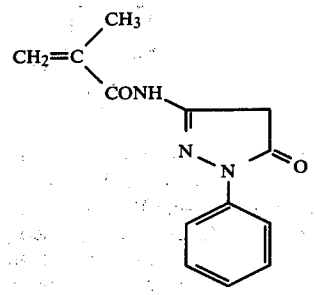

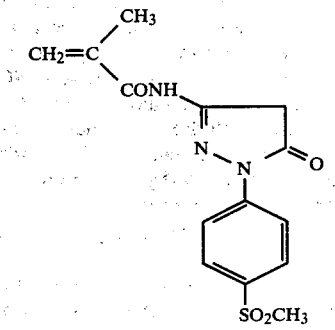

-continued
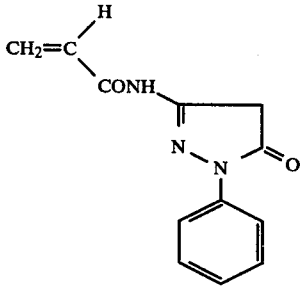
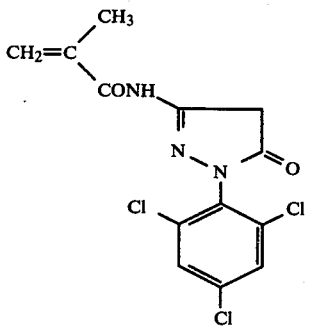
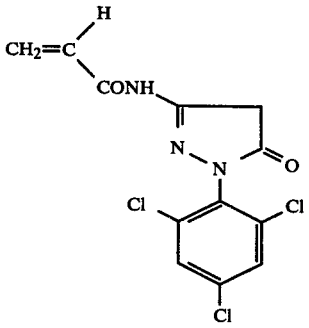
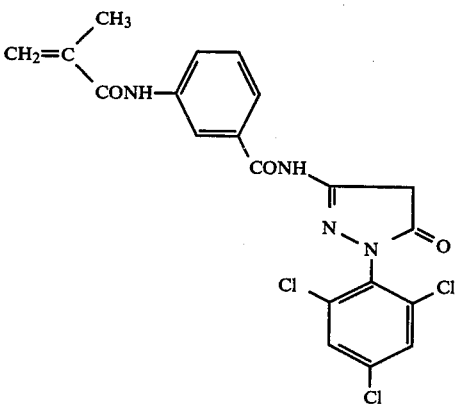
-continued
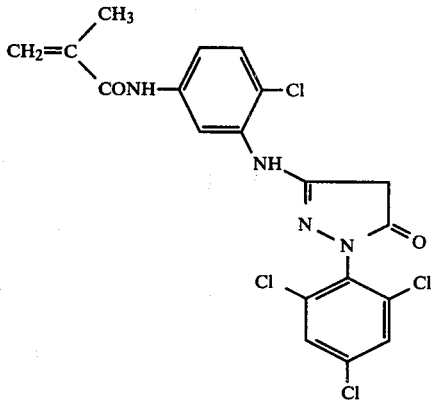
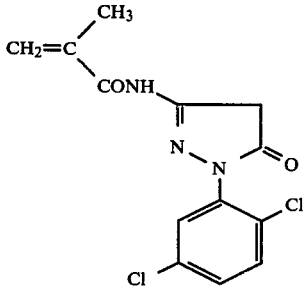
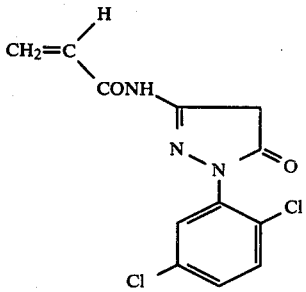
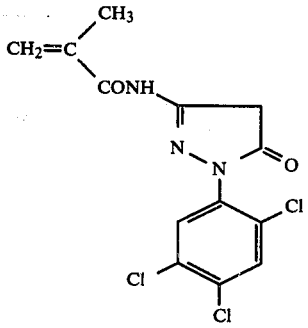
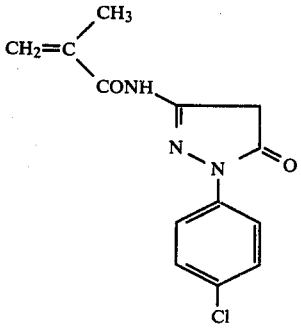

-continued
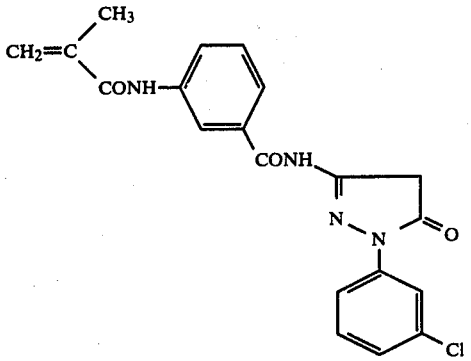
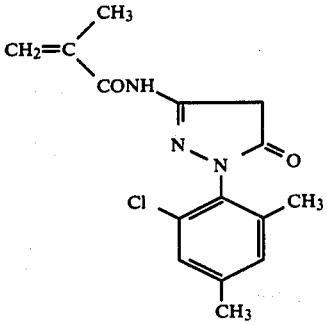
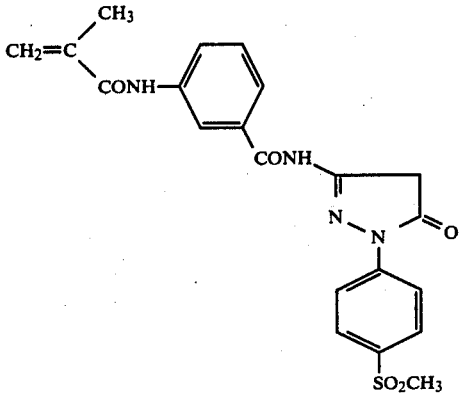
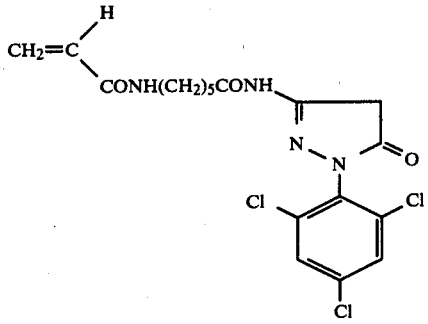
-continued
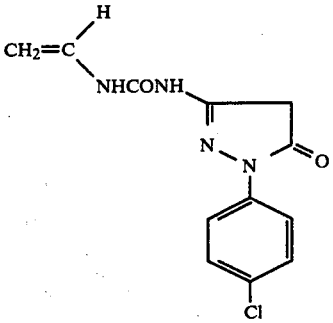
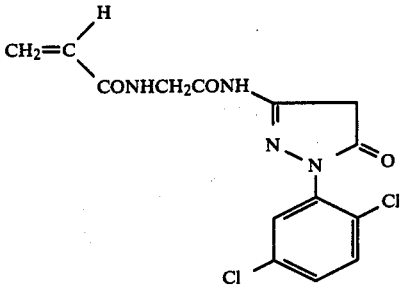
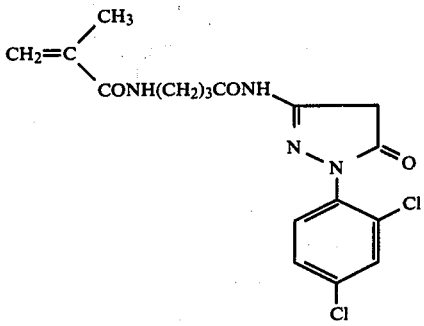
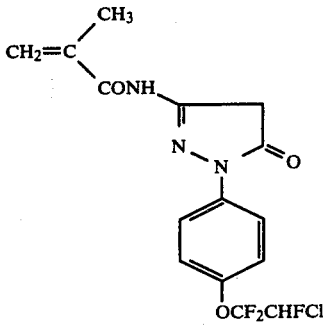
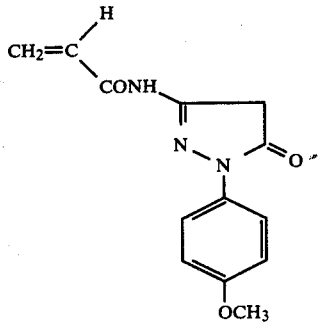

-continued

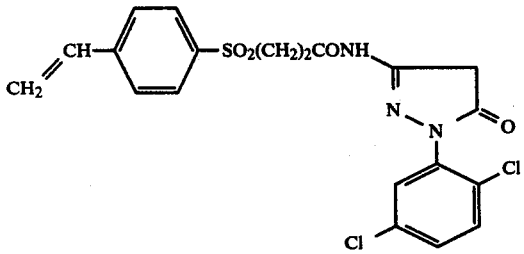

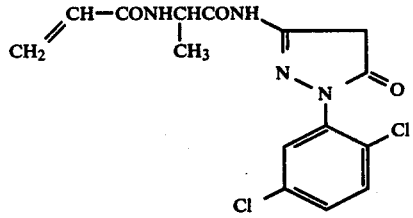

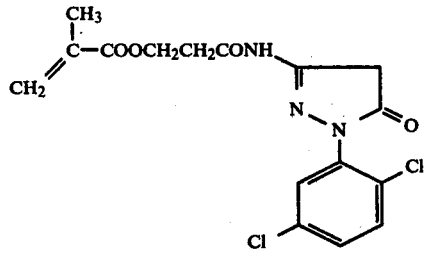

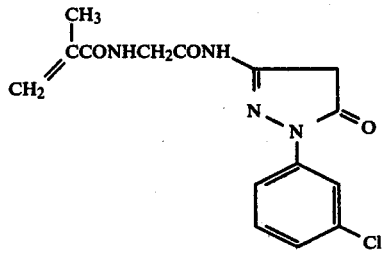

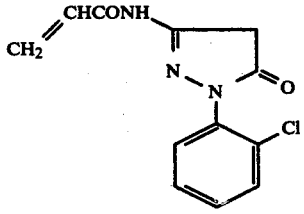

In the photographic light-sensitive materials of the present invention, the photographic emulsion layers and other layers are applied to flexible supports such as plastic films, paper, cloth, etc., or rigid supports such as glass, ceramics, metal, etc., which are conventionally used for photographic light-sensitive materials. Examples of useful flexible supports include films composed of semi-synthetic or synthetic high molecular materials such as cellulose nitrate, cellulose acetate, cellulose acetate butyrate, polystyrene, polyvinyl chloride, polyethylene terephthalate, polycarbonate, etc., and papers coated or laminated with baryta, α-olefin polymers (for example, polyethylene, polypropylene or ethylene/butene copolymer), etc. The supports may be colored by dyes or pigments. They also may have a black color for the purpose of light-shielding. The surface of these supports is generally subjected to an undercoating treatment in order to improve adhesion to the photographic emulsion layer, etc. The surface of the supports may be subjected to corona discharging, ultraviolet ray application, flame treatment, etc., prior to or after the undercoating treatment.

The present invention can be applied to multilayer multicolor photographic materials having at least two different spectral sensitivities. The multilayer technicolor photographic materials have generally at least one red-sensitive emulsion layer, at least one green-sensitive emulsion layer and at least one blue-sensitive emulsion layer on the support. The order of superposition of these layers can be suitably varied. Ordinarily, the red-sensitive emulsion layer contains a cyan coupler, the green-sensitive emulsion layer contains a magenta coupler and the blue-sensitive emulsion layer contains a yellow coupler. However, if necessary, other combinations may be utilized.

In carrying out the preparation of the emulsions, removal of soluble salts from the emulsions after precipitation or physical aging may be carried out by a noodle washing method in which gelatin is gelated, or by a flocculation method utilizing inorganic salts, anionic surface active agents, anionic polymers (for example, polystyrenesulfonic acid), or gelatin derivatives (for example, acylated gelatin, carbamoylated gelatin, etc.).

The silver halide emulsions are generally chemically sensitized. In order to carry out chemical sensitization, it is possible to use processes as described in *Die Grundlagen der Photographischen Prozesse mit Silberhalogeniden,* edited by H. Frieser (Akademische Verlagsgesellschaft, 1968), pages 675–734.

Namely, it is possible to use a sulfur sensitization process which comprises using active gelatin and sulfur containing compounds capable of reacting with silver (for example, thiosulfates, thioureas, mercapto compounds or rhodanines); a reduction sensitization process which comprises using reducing substances (for example, stannous salts, amines, hydrazine derivatives, formamidinesulfinic acid and silane compounds); and a noble metal sensitization process which comprises using noble metal compounds (for example, gold complex salts and complex salts of metals belonging to Group VIII in the Periodic Table, such as Pt, Ir, Pd, etc.), which may be used alone or as a combination thereof.

Examples of the sulfur sensitization process have been described in U.S. Pat. Nos. 1,574,944, 2,410,689, 2,278,947, 2,728,668 and 3,656,955, those of the reduction sensitization process have been described in U.S. Pat. Nos. 2,983,609, 2,419,974 and 4,054,458. Further, examples of the noble metal sensitization process have been described in U.S. Pat. Nos. 2,399,083 and 2,448,060 and British Pat. No. 618,061, etc.

As the binder or the protective colloid for the photographic emulsions of the photographic light-sensitive materials of the present invention, gelatin is advantageously used, but other hydrophilic colloids can also be used.

For example, it is possible to use proteins such as gelatin derivatives, graft polymers of gelatin and other high molecules, albumin, casein, etc.; saccharides such as cellulose derivatives such as hydroxyethyl cellulose, carboxymethyl cellulose, cellulose sulfate, etc., sodium alginate, starch derivatives; and various synthetic hydrophilic high molecular substances such as homopolymers or copolymers, for example, polyvinyl alcohol, polyvinyl alcohol hemiacetal, poly-N-vinylpyrrolidone, polyacrylic acid, polymethacrylic acid, polyacrylamide, polyvinylimidazole, polyvinylpyrazole, etc.

As gelatin, not only lime-processed gelatin, but also acid-processed gelatin and enzyme-processed gelatin described in *Bull. Soc. Sci. Phot. Japan,* No. 16, page 30 (1966) may be used. Further, hydrolyzed products or enzymatic products of gelatin can also be used.

Examples of typical synthetic hydrophilic high molecular substances include those described in German Patent Application (OLS) No. 2,312,708, U.S. Pat. Nos. 3,620,751 and 3,879,205, and Japanese Patent Application No. 7561/68.

Further, in the photographic light-sensitive materials of the present invention, it is possible to add dispersions of water-soluble or sparingly soluble synthetic polymers to photographic emulsion layers and other hydrophilic colloid layers in order to improve the dimensional stability. For example, it is possible to use polymers composed of one or more monomers selected from alkyl acrylates, alkyl methacrylates, alkoxyalkyl acrylates, alkoxyalkyl, methacrylates, glycidyl acrylates, glycidyl methacrylates, acrylamide, methacrylamide, vinyl esters (for example, vinyl acetate), acrylonitrile, olefins, styrene, etc., and polymers composed of a combination of the above-described monomers and acrylic acid, methacrylic acid, $\alpha,\beta$-unsaturated dicarboxylic acid, hydroxyalkyl acrylate, hydroxyalkyl methacrylate, sulfoalkyl acrylate, sulfoalkyl methacrylate, styrenesulfonic acid, etc. Examples of these include those described in U.S. Pat. Nos. 2,376,005, 2,739,137, 2,853,457, 3,062,674, 3,411,911, 3,488,708, 3,525,620, 3,607,290, 3,635,715, 3,645,740 and British Pat. Nos. 1,186,699 and 1,307,373.

In the light-sensitive materials of the present invention, the hydrophilic colloid layers may be mordanted by cationic polymers if they contain dyes. For example, it is possible to use polymers described in British Pat. No. 685,475, U.S. Pat. Nos. 2,675,316, 2,839,401, 2,882,156, 3,048,487, 3,184,309 and 3,445,231, German Patent Application (OLS) No. 1,914,362 and Japanese Patent Application (OPI) Nos. 47624/75 and 71332/75.

In the photographic light-sensitive materials of the present invention, the photographic emulsion layers and other hydrophilic colloid layers may contain inorganic or organic hardeners. It is possible to use chromium salts (chromium alum, chromium acetate, etc.), aldehydes (formaldehydes, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-divinylsulfonyl-2-propanol, 1,2-di(vinylsulfonylacetamido)ethane, 1,3-di(vinylsulfonylacetamido)propane, bis(vinylsulfonylmethyl)ether, 1,3-divinylsulfonylpropane, 1,2-divinylsulfonylethane, 1,3,5-trivinylsulfonylhexahydro-s-triazine, etc.), active halogen compounds (2,4-dichloro-6-hydroxy-s-triazine, etc.), and mucohalogenic acids (mucochloric acid, mucophenoxychloric acid, etc.), which are used alone or as a combination thereof.

The photographic emulsion layers and other hydrophilic colloid layers in the light-sensitive materials of the present invention may contain surface active agents for various purposes, for example, as coating assistants, or for prevention of electrical charging, improvement of lubricating property, emulsification, prevention of adhesion, improvement of photographic properties (for example, acceleration of development, hard tone or sensitization), etc.

It is possible to use nonionic surface active agents such as saponin (steriod), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicone, etc.), glycidol derivatives (for example, alkenylsuccinic acid polyglycerides and alkylphenol polyglycerides), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic sulfonium salts, aliphatic or heterocyclic phosphonium salts, etc. In addition, fluorine containing surface active agents may be used.

In the photographic emulsion layers of the photographic light-sensitive materials of the present invention, any of silver bromide, silver iodobromide, silver iodochlorobromide, silver chlorobromide and silver chloride may be used as the silver halide. Preferred silver halide is silver iodobromide.

The photographic emulsions used in the present invention may be spectrally sensitized by methine dyes or others. Although these sensitizing dyes can be used alone, they may be used as a combination of two or more of them. The combination of the sensitizing dyes is often used for the purpose of supersensitization. The emulsions may contain dyes which do not have a spectral sensitization function themselves or substances which do not substantially absorb visible rays and show supersensitization, together with the sensitizing dyes.

Suitable sensitizing dyes, combinations of dyes which show supersensitization and substances which show supersensitization have been described in *Research Disclosure,* Vol. 176, No. 17643 (Dec., 1978), page 23 IV-J.

In the light-sensitive materials of the present invention, the hydrophilic colloid layers may contain water-soluble dyes as filter dyes or for the purpose of preventing irradiation or for other purposes. Examples of such dyes include oxonol dyes, hemioxonol dyes, styryl dyes, merocyanine dyes, cyanine dyes and azo dyes. Particularly, oxonol dyes, hemioxonol dyes and merocyanine dyes are useful.

For the purpose of increasing sensitivity, increasing contrast or accelerating development, the photographic emulsion layers of the photographic light-sensitive materials of the present invention may contain, for example, polyalkylene oxide or derivatives thereof such as ethers, esters, amines, etc., thioether compounds, thiomorpholines, quaternary ammonium compounds, urethane derivatives, urea derivatives, imidazole derivatives, 3-pyrazolidones, etc. For example, it is possible to use those described in U.S. Pat. Nos. 2,400,532, 2,423,549, 2,716,062, 3,617,280, 3,772,021 and 3,808,003, British Pat. No. 1,488,991, etc.

In the photographic emulsions used in the present invention, it is possible to incorporate various compounds for the purpose of preventing fogging in the production of the light-sensitive materials, during preservation thereof or during photographic processing or for the purpose of stabilizing photographic properties. For example, it is possible to add various known anti-fogging agents or stabilizers such as azoles, for example, benzothiazolium salts, nitroindazoles, triazoles, benzotriazoles or benzimidazoles (particularly, nitro- or halogen-substituted benzimidazoles); heterocyclic mercapto compounds, for example, mercaptothiazoles, mercaptobenzothiazoles, mercaptobenzimidazoles, mercaptothiadiazoles, mercaptotetrazoles (particularly, 1-phenyl-5-mercaptotetrazole) or mercaptopyrimidines; the above-described heterocyclic mercapto compounds having water-soluble groups such as a carboxyl group, a sulfo group, etc.; thioketo compounds, for example, oxazolinethione; azaindenes, for example, tetraazaindenes (particularly, 4-hydroxy substituted-(1,3,3a,7)tetraazaindenes); benzenethiosulfonic acids; benzenesulfinic acids, gallic acid derivatives as described in Japanese Patent Application (OPI) No. 17431/83, etc.

The light-sensitive materials of the present invention may contain hydroquinone derivatives, aminophenol derivatives, gallic acid derivatives, ascorbic acid derivatives, etc., as anti-color-fogging agents.

In carrying out the present invention, known anti-fading agents can be used together. Further, the dye image stabilizers used in the present invention can be used alone or as a mixture of two or more thereof. Examples of the known anti-fading agents include hydroquinone derivatives, gallic acid derivatives, p-alkoxyphenols, p-oxyphenol derivatives, bisphenols, etc.

Examples of hydroquinone derivatives have been described in U.S. Pat. Nos. 2,360,290, 2,418,613, 2,675,314, 2,701,197, 2,704,713, 2,728,659, 2,732,300, 2,735,765, 2,710,801 and 2,816,028, British Pat. No. 1,363,921, etc., those of gallic acid derivatives have been described in U.S. Pat. Nos. 3,457,079, 3,069,262, etc., those of p-alkoxyphenols have been described in U.S. Pat. Nos. 2,735,765 and 3,698,909 and Japanese Patent Publication Nos. 20977/74 and 6623/77, those of p-oxyphenol derivatives have been described in U.S. Pat. Nos. 3,432,300, 3,573,050, 3,574,627 and 3,764,337 and Japanese Patent Application (OPI) Nos. 35633/77, 147434/77 and 152225/77, and those of bisphenols have been described in U.S. Pat. No. 3,700,455.

In the photographic light-sensitive materials of the present invention, the emulsion layers or adjacent layers thereof may contain ultraviolet ray absorbing agents other than the present invention for the purpose of image stabilization. For example, particularly good effects can be obtained when long wavelength type aminobutadiene ultraviolet ray absorbing agents as described, for example, in U.S. Pat. Nos. 4,195,999 and 4,163,671, Japanese Patent Publication Nos. 19767/82 and 19771/82, Japanese Patent Application (OPI) Nos. 27146/81 and 56620/76, U.S. Pat. Nos. 4,247,627 and 4,307,184, etc., are used together with. Further, it can be used together with ultraviolet ray absorbing agents as described, for example, in U.S. Pat. No. 3,533,794, Japanese Patent Publication No. 36984/80, Japanese Patent Application (OPI) Nos. 151149/75 and 50245/80, U.S. Pat. Nos. 4,220,771, 3,738,837 and 3,698,907, Japanese Patent Publication No. 26139/74, U.S. Pat. Nos. 3,253,921 and 4,235,999, Japanese Patent Publication No. 33773/75, U.S. Pat. Nos. 4,200,464, 3,707,375 and 3,705,805, etc.

The present invention can be utilized for light-sensitive materials having a low silver content in which the amount of silver halide in the emulsions is one half to one hundredth of the conventional light-sensitive materials. In such color light-sensitive materials having a low silver halide content, sufficient color images can be obtained by an image formation process wherein the amount of dyes formed is increased by utilizing color intensification, which comprises using peroxides, cobalt complex salts or sodium chlorite as taught in German Patent Application (OLS) No. 2,357,694, U.S. Pat. Nos. 3,674,490 and 3,761,265, German Patent Application (OLS) Nos. 2,044,833, 2,056,359, 2,056,360 and 2,226,770, Japanese Patent Application (OPI) Nos. 9728/73 and 9729/73, etc.

Color development of the photographic light-sensitive materials of the present invention can be carried out by conventional processes known hitherto. Namely, it is possible to use a negative-positive process which comprises carrying out color development with substituted p-phenylenediamine to form a dye image and a silver image, processing with a bleaching bath to oxidize into a silver salt, and removing the residual silver halide and other silver salts by dissolving with a fixing bath to leave the dye image; and a color reversal process which comprises forming a negative silver image by developing with a developing agent containing a black-and-white developing agent, carrying out at least one uniform exposure or suitable fogging treatment, and subsequently carrying out color development, bleaching and fixation to obtain a dye positive image.

Further, in color X-ray films utilizing the developed silver image and the developed dye image, it is possible to use a process comprising color development and fixation which does not comprise bleaching.

The temperature of these color photographic processing is selected from a range of from 18° C. to 50° C., but it is possible to use a temperature of lower than 18° C. or higher than 50° C.

As the p-phenylenediamine derivatives for developing the photographic light-sensitive materials of the present invention, many compounds known hitherto can be used. Particularly suitable p-phenylenediamine developing agent include N,N-dialkyl-p-phenylenediamine compounds the alkyl groups and the phenyl group of which may be substituted or unsubstituted. Among them, examples of particularly suitable compounds include N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-(β-methanesulfonamidoethyl-3-methyl-4-aminoaniline sulfate, N-ethyl-N-β-hydroxyethylaminoaniline, 4-amino-N-(2-methoxyethyl)-N-ethyl-3-methylaniline-p-toluenesulfonate, N,N-diethyl-3-methyl-4-aminoaniline, N-ethyl-N-(β-hydroxyethyl)-3-methyl-4-aminoaniline, etc.

In addition, compounds described in L. F. A. Mason, *Photographic Processing Chemistry* (published by Focal Press, 1966), pages 226–229 and U.S. Pat. Nos. 2,193,015 and 2,592,364 and Japanese Patent Application (OPI) No. 64933/73 may be used.

The color developing solution may contain pH buffer agents, development restrainers, anti-fogging agents, etc. If desired, it may contain water softeners, preservatives, organic solvents, development accelerators, dye forming couplers, competing couplers, fogging agents, auxiliary developing agents, thickening agents, polycarboxylic acid chelating agents, antioxidants, etc.

The bleaching processing may be carried out simultaneously with the fixing processing or these processings may be carried out separately. As the bleaching agent, compounds of polyvalent metal such as iron (III), cobalt (III), chromium (VI), copper (II), etc., peracids, quinones, nitroso compounds, etc., may be used. For example, it is possible to use ferricyanides, bichromates, organic complex salts of iron (III) or cobalt (III), complex salts of aminopolycarboxylic acids such as ethylenediaminetetraacetic acid, nitrilotriacetic acid, 1,3-diamino-2-propanoltetraacetic acid, etc., or organic acids such as citric acid, tartaric acid, malic acid, etc.; persulfates, permanganates, nitrosophenol, etc. Among them, potassium ferricyanide, sodium (ethylenediaminetetraacetato) iron (III) and ammonium (ethylenediaminetetraacetato) iron (III) are particularly preferred. The (ethylenediaminetetraacetato) iron (III) complex salts are useful for both the bleaching solution and the one-bath bleach-fix solution.

To the bleaching solution or the bleach-fix solution, it is possible to add various additives including bleaching accelerators described in U.S. Pat. Nos. 3,042,520 and 3,241,966 and Japanese Patent Publication Nos. 8506/70 and 8836/70 and thiol compounds described in Japanese Patent Application (OPI) No. 65732/78.

Examples of the fixing agent include thiosulfates (for example, ammonium thiosulfate, sodium thiosulfate, potassium thiosulfate, etc.), thiocyanides (for example, ammonium thiocyanide, sodium thiocyanide, potassium thiocyanide, etc.) and thioether compounds such as 3,6-dithia-1,8-octanediol. These compounds may be used alone or as a mixture of two or more thereof.

The present invention will now be described in more detail with reference to the following examples, but the present invention is not to be construed as being limited thereto.

EXAMPLE 1

On a cellulose triacetate support having a subbing layer was coated an emulsion layer having the composition set forth below and further on the emulsion layer was coated a protective layer having the composition set forth below to prepare a sample.

COMPOSITION OF COATING SOLUTION FOR EMULSION LAYER

Green-Sensitive Silver Iodobromide Emulsion (silver coated amount: 1 g/m$^2$)

Magenta Coupler (1)* (coated amount: $6\times10^{-4}$ mol/m$^2$)

Solvent for Dispersing Coupler: Tricresyl Phosphate

*Magenta Coupler (1)

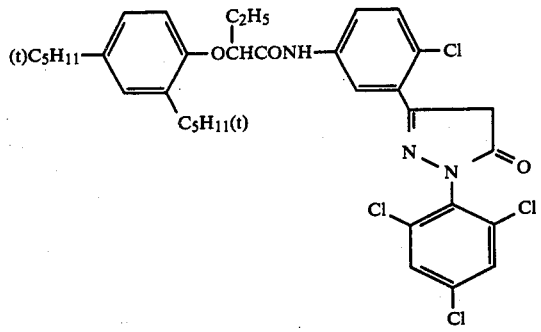

A protective layer comprising a coemulsification latex of Aldehyde Scavenger (S-2) and Oleophilic Polymer Ultraviolet Ray Absorbing Agent (P-27) was prepared in the following manner.

Solution (a): 70 g of a 10% by weight aqueous solution of bone gelatin (pH: 5.6 at 35° C.) was heated to 32° C. to dissolve.

Solution (b): 2.5 g of Oleophilic Polymer Ultraviolet Ray Absorbing Agent (P-27) and 3 g of Aldehyde Scavenger (S-2) were dissolved in 20 g of ethyl acetate at 38° C., and 10 ml of a 70% by weight methanol solution of sodium dodecylbenzenesulfonate was added thereto.

Then, Solutions (a) and (b) were put into a mixer with explosion preventing equipment. After stirring for 1 minute at a high speed, the operation of the mixer was stopped and the ethyl acetate was distilled off under a reduced pressure. Thus, a latex in which the oleophilic polymer ultraviolet ray absorbing agent and the aldehyde scavenger were dispersed in a diluted aqueous solution of gelatin was prepared. The latex was coated on the above-described emulsion layer in an amount of the aldehyde scavenger of 1.0 g/m$^2$ as a protective layer to prepare Sample (A).

In the same manner, Samples (B), (C), (D) and (E) having a protective layer comprising a coemulsification latex of the combination of (S-32) and (P-27), (S-4) and (P-34), (S-7) and (P-27), and (S-13) and (P-27), respectively were prepared.

Further, a protective layer comprising a coemulsification latex of Aldehyde Scavenger (S-5) and Homopolymer Ultraviolet Ray Absorbing Latex (P-5) which was obtained from Compound (III-5) was prepared in the following manner. Specifically, 30 ml of a 10% by weight methanol solution of Aldehyde Scavenger (S-5), 200 ml of an aqueous solution containing 15 g of bone gelatin and 30 ml of Latex (P-5) were mixed. The mixture was coated on the above-described emulsion layer in an amount of Aldehyde Scavenger (S-5) of 1.0 g/m$^2$ as a protective layer to prepare Sample (F).

For comparison, Samples (G) and (H) were prepared only using Aldehyde Scavengers (S-4) and (S-2), respectively, and Sample (I) was prepared without using any aldehyde scavenger.

The above-described Samples (A) to (I) were stored for 24 hours in a sealed container having an atmosphere of 40° C., relative humidity of 70% and formaldehyde gas concentration of 10 ppm. Then, the samples were exposed to light and subjected to the color development processing described below. For comparison, Samples (A) to (I) which were not brought into contact with formaldehyde gas were processed at the same time.

| Color Development Processing Step | Time | Temperature (°C.) |
|---|---|---|
| 1. Color Development | 3 min 15 sec | 38 |
| 2. Bleaching | 6 min 30 sec | " |
| 3. Washing with Water | 2 min | " |
| 4. Fixing | 4 min | " |
| 5. Washing with Water | 4 min | " |
| 6. Stabilizing | 1 min | " |

The processing solutions used in the color development processing had the following compositions:

| Color Developer Solution | |
|---|---|
| Water | 800 ml |
| 4-(N—Ethyl-N—hydroxyethyl)amino-2-methylaniline Sulfate | 5 g |
| Sodium Sulfite | 5 g |
| Hydroxylamine Sulfate | 2 g |
| Potassium Carbonate | 30 g |
| Potassium Hydrogencarbonate | 1.2 g |
| Potassium Bromide | 1.2 g |
| Sodium Chloride | 0.2 g |
| Trisodium Nitrilotriacetate | 1.2 g |
| Water to make | 1 l |
| | (pH 10.1) |

| Bleaching Solution | |
|---|---|
| Water | 800 ml |
| Iron (III) Ammonium Ethylenediamine-tetraacetate | 100 g |
| Disodium Ethylenediaminetetraacetate | 10 g |
| Potassium Bromide | 150 g |
| Acetic Acid | 10 g |
| Water to make | 1 l |
| | (pH 6.0) |

| Fixing Solution | |
|---|---|
| Water | 800 ml |
| Ammonium Thiosulfate | 150 g |
| Sodium Sulfite | 10 g |
| Sodium Hydrogensulfite | 2.5 g |
| Water to make | 1 l |
| | (pH 6.0) |

| Stabilizing Solution | |
|---|---|
| Water | 800 ml |
| Formalin (37 wt % formaldehyde) | 5 ml |
| Fuji Driwel | 3 ml |
| Water to make | 1 l |

After the color development processing, the magenta maximum color forming density of each sample was measured and the degree of decrease in magenta density due to formaldehyde gas was evaluated. The results obtained are shown in Table 1 below.

Rate of Decrease in Density =

$$1 - \frac{\text{Color Forming Density of Sample Treated with Formaldehyde}}{\text{Color Forming Density of Sample Not Treated with Formaldehyde}} \times 100$$

TABLE 1

| Sample No. | Aldehyde Scavenger | Polymer Latex | Rate of Decrease in Density (%) |
|---|---|---|---|
| A (Present Invention) | (S-2) | (P-27) | 8 |
| B (Present Invention) | (S-32) | (P-27) | 3 |
| C (Present Invention) | (S-4) | (P-34) | 5 |
| D (Present Invention) | (S-7) | (P-27) | 7 |
| E (Present Invention) | (S-13) | (P-27) | 11 |
| F (Present Invention) | (S-5) | (P-5) | 8 |
| G (Comparison) | (S-4) | — | 20 |
| H (Comparison) | (S-2) | — | 18 |
| I (Comparison) | — | — | 43 |

It is apparent from the results shown in Table 1 above that the disadvantage in that the effect is decreased due to the diffusion of the aldheyde scavenger into other layers is remarkably eliminated by loading the aldehyde scavenger into the ultraviolet ray absorbing polymer latex according to the present invention.

EXAMPLE 2

On a cellulose triacetate film support were coated layers having the compositions set forth below to prepare a multilayer color photographic light-sensitive material.

First Layer: Antihalation Layer (AHL)

A gelatin layer containing black colloidal silver

Second Layer: Intermediate Layer (ML)

A gelatin layer containing a dispersion of 2,5-di-tert-octylhydroquinone

Third Layer: First Red-Sensitive Emulsion Layer ($RL_1$)

A silver iodobromide emulsion (iodide content: 5 mol%)

| | Silver coated amount: 1.79 g/m$^2$ |
|---|---|
| Sensitizing Dye I | $6 \times 10^{-5}$ mol per mol of silver |
| Sensitizing Dye II | $1.5 \times 10^{-5}$ mol per mol of silver |
| Coupler A | 0.04 mol per mol of silver |
| Coupler C-1 | 0.0015 mol per mol of silver |
| Coupler C-2 | 0.0015 mol per mol of silver |
| Coupler D | 0.0006 mol per mol of silver |

Fourth Layer: Second Red-Sensitive Emulsion Layer ($RL_2$)

A silver iodobromide emulsion (iodide content: 4 mol%)

| | Silver coated Amount: 1.4 g/m$^2$ |
|---|---|
| Sensitizing Dye I | $3 \times 10^{-5}$ mol per mol of silver |
| Sensitizing Dye II | $1.2 \times 10^{-5}$ mol per mol of silver |
| Coupler A | 0.02 mol per mol of silver |
| Coupler C-1 | 0.0008 mol per mol of silver |
| Coupler C-2 | 0.0008 mol per mol of silver |

Fifth Layer: Intermediate Layer (ML)

Same as the Second Layer

Sixth Layer: First Green-Sensitive Emulsion Layer ($GL_1$)

A silver iodobromide emulsion (iodide content: 4 mol%)

| | Silver coated amount: 1.5 g/m$^2$ |
|---|---|
| Sensitizing Dye III | $3 \times 10^{-5}$ mol per mol of silver |
| Sensitizing Dye IV | $1 \times 10^{-5}$ mol per mol of silver |

-continued

| | Silver coated amount: 1.5 g/m$^2$ |
|---|---|
| Coupler B | 0.05 mol per mol of silver |
| Coupler M-1 | 0.008 mol per mol of silver |
| Coupler D | 0.0015 mol per mol of silver |

Seventh Layer: Second Green-Sensitive Emulsion Layer ($GL_2$)

A silver iodobromide emulsion (iodide content: 5 mol%)

| | Silver coated amount: 1.6 g/m$^2$ |
|---|---|
| Sensitizing Dye III | $2.5 \times 10^{-5}$ mol per mol of silver |
| Sensitizing Dye IV | $0.8 \times 10^{-5}$ mol per mol of silver |
| Coupler B | 0.02 mol per mol of silver |
| Coupler M-1 | 0.003 mol per mol of silver |
| Coupler D | 0.0003 mol per mol of silver |

Eighth Layer: Yellow Filter Layer (YFL)

A gelatin layer containing yellow colloidal silver and a dispersion of 2,5-di-tert-octylhydroquinone Ninth Layer: First Blue-Sensitive Emulsion Layer ($BL_1$)

A silver iodobromide emulsion (iodide content: 6 mol%)

| | Silver coated amount: 1.5 g/m$^2$ |
|---|---|
| Coupler Y | 0.25 mol per mol of silver |

Tenth Layer: Second Blue-Sensitive Emulsion Layer ($BL_2$)

A silver iodobromide emulsion (iodide content: 6 mol%)

| | Silver coated amount: 1.1 g/m$^2$ |
|---|---|
| Coupler Y | 0.06 mol per mol of silver |

Eleventh Layer: Protective Layer (PL)

A latex prepared in the same manner as described in Sample (A) of Example 1 using the combination of Aldehyde Scavenger (S-27) and Oleophilic Polymer Ultraviolet Ray Abosrbing Agent (P-27), (S-37) and (P-34), (S-44) and (P-27), (S-39) and (P-27), and (S-35) and (P-34), respectively, was coated in an amount of the aldehyde scavenger of 1.0 g/m$^2$ to prepare Samples (J), (K), (L), (M) and (N), respectively.

For comparison, an emulsion prepared by emulsifying (S-39) and Ultraviolet Ray Absorbing Agent (U) having the formula described below, (S-44) and (U), (U) alone, and (S-39) alone, respectively, using an organic solvent having a high boiling point in the manner as described below was coated to prepare Samples (O), (P), (Q) and (R), respectively.

Ultraviolet Ray Absorbing Agent (U)

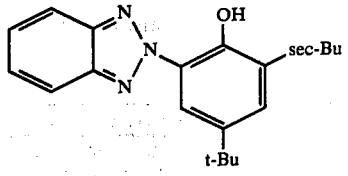

Two kinds of Solutions (a) and (B) were prepared in the following manner.

Solution (a): 1,000 g of a 10% by weight aqueous solution of bone gelatin (pH: 5.6 at 35° C.) was heated to 40° C. to dissolve.

Solution (b): 42 g of Compound (S-39) and 36 g of (U) were dissolved in a solvent mixture composed of 90 g of dibutyl phthalate and 180 g of ethyl acetate as an auxiliary solvent at 38° C., and 57 g of a 72% by weight methanol solution of sodium dodecylbenzenesulfonate was added to the resulting solution.

Then, Solutions (a) and (b) were put into a mixer with explosion preventing equipment. After being stirred for 1 minute at a high speed, the operation of the mixer was stopped and the ethyl acetate was distilled off under a reduced pressure. Thus, emulsified dispersion containing Compound (S-39) and (U) was prepared. In the same manner, emulsified dispersions containing (S-44) and (U), (U) alone, and (S-39) alone, respectively, were prepared.

Furthermore, Sample (S) was prepared by coating an aqueous solution of bone gelatin alone, for comparison.

The compounds used for the preparation of the above-described samples were:

Sensitizing Dye I:

Pyridinium salt of anhydro-5,5'-dichloro-3,3'-di(γ-sulfopropyl)-9-ethylthiacarbocyanine hydroxide Sensitizing Dye II:

Triethylamine salt of anhydro-9-ethyl-3,3'-di(γ-sulfopropyl)-4,5,4',5'-dibenzothiacarbocyanine hydroxide Sensitizing Dye III:

Sodium salt of anhydro-9-ethyl-5,5'-dichloro-3,3'-di(γ-sulfopropyl)oxacarbocyanine Sensitizing Dye IV:

Sodium salt of anhydro-5,6,5',6'-tetrachloro-1,1'-diethyl-3,3'-di{β-[β-(γ-sulfopropoxy)ethoxy]ethyl}-imidazolocarbocyanine hydroxide Coupler A:

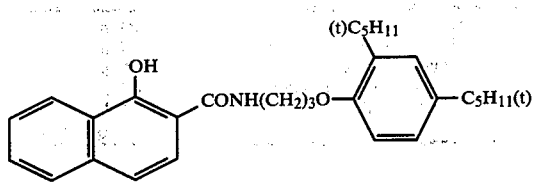

Coupler B:

Coupler Monomer (B-1)

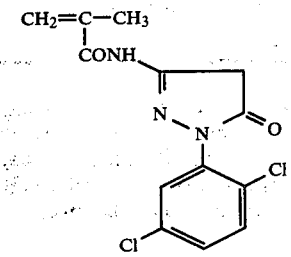

Comonomer (B-2)

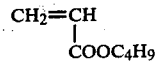

The polymer coupler consisting of Coupler Monomer (B-1) and Comonomer (B-2) was prepared so as to contain 50% by weight of Coupler Monomer (B-1).

Coupler C-1:

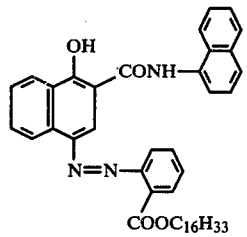

Coupler C-2:

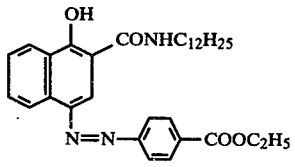

Coupler D:

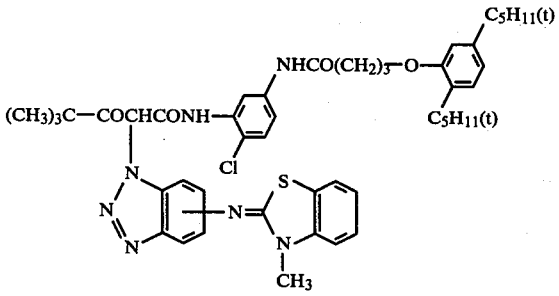

Coupler M-1:

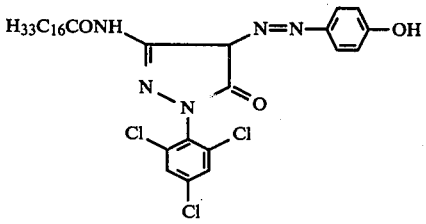

Coupler Y:

-continued

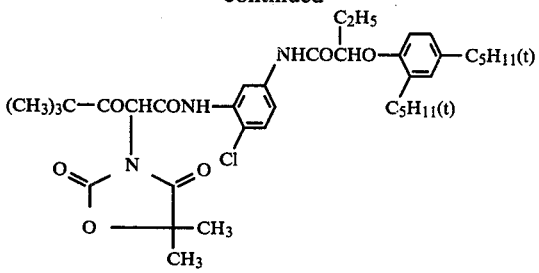

The samples prepared in the manner described above were subjected to the same treatment as described in Example 1 to evaluate the rate of decrease in density. Further, with respect to these samples, a film property, an antiadhesive property and image sharpness were measured by the following methods. The results thus obtained are shown in Table 2 below.

(a) Film Property

After a strip of the sample was immersed in a color developing solution for processing CN-16 (manufactured by Fuji Photo Film Co., Ltd.) at 25° C. for 5 minutes, it was then scratched by means of a scratch strength tester equipped with a sapphire pin having a diameter of 0.1 mm to which a weight of 0 to 200 g was continuously applied, and film strength was examined by measuring the weight by which a scratch began to be made.

(b) Antiadhesion Test

A sample was cut in a size of 35 square mm. After the strips were conditioned for 1 day under a condition of 25° C. and 90% RH in such a state that each of them did not contact one another, they were preserved in such a state that the emulsion face was in contact with the back face under a condition of 40° C. and 90% RH for 2 days while applying a weight of 500 g. The films taken out were separated and the % area of the adhesion part was measured.

Valuations A to D are as follows.

| | | |
|---|---|---|
| A: | Adhesion area | 0–40% |
| B: | Adhesion area | 40–60% |
| C: | Adhesion area | 60–80% |

(c) Image Sharpness

Image sharpness was determined by obtaining a response function (modulation transfer function; which is referred to as MTF, hereinafter) and comparing MTF values in a certain frequency. Measurement of MTF was carried out according to the method described in Masao Takano and Ikuo Fujimura, *Hihakaikensa,* Vol. 6, pages 472–482 (1967). Exposure was carried out using white light, and measurements in R, G and B layers were carried out through red, green and blue filters, respectively.

In Table 2 below, TMF values in a frequency of 20 per mm are shown. The MTF value being larger means that reproduction of fine parts of images is more excellent, namely, image sharpness is higher.

TABLE 2

| Sample No. | Aldehyde Scavenger | Polymer Latex | Rate of Decrease in Density (%) | Film Strength (g) | Anti-adhesion | MTF Value R (%) | MTF Value G (%) | MTF Value B (%) |
|---|---|---|---|---|---|---|---|---|
| J | (S-27) | (P-27) | 17 | 174 | A | 73 | 80 | 85 |

TABLE 2-continued

| Sample No. | Aldehyde Scavenger | Polymer Latex | Rate of Decrease in Density (%) | Film Strength (g) | Anti-adhesion | MTF Value R (%) | G (%) | B (%) |
|---|---|---|---|---|---|---|---|---|
| (Present Invention) K | (S-37) | (P-34) | 15 | 170 | A | 72 | 80 | 83 |
| (Present Invention) L | (S-44) | (P-27) | 13 | 172 | A | 72 | 79 | 84 |
| (Present Invention) M | (S-39) | (P-27) | 12 | 169 | A | 72 | 80 | 85 |
| (Present Invention) N | (S-35) | (P-34) | 15 | 170 | A | 71 | 78 | 84 |
| (Present Invention) O | (S-39) | (U) | 18 | 44 | C | 63 | 71 | 77 |
| (Comparison) P | (S-44) | (U) | 17 | 42 | C | 61 | 72 | 75 |
| (Comparison) Q | — | (U) | 58 | 53 | C | 72 | 78 | 82 |
| (Comparison) R | (S-39) | — | 18 | 50 | C | 71 | 76 | 80 |
| (Comparison) S | — | — | 59 | 180 | A | 76 | 82 | 89 |
| (Comparison) | | | | | | | | |

It is apparent from the results shown in Table 2 above that the great improvements in the film strength and the antiadhesive property are observed and the excellent sharpness is obtained by using the ultraviolet ray absorbing polymer latex in which the aldehyde scavenger is loaded according to the present invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon a light-sensitive silver halide emulsion layer and a light-insensitive layer, the color photographic light-sensitive material contains in a layer, selected from the light-sensitive silver halide emulsion layer and the light-insensitive layer, a compound which is capable of reacting with and fixing formaldehyde gas represented by the following general formula (I) or (II):

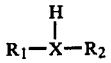

(I)

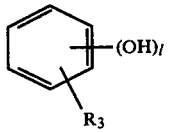

(II)

wherein $R_1$ and $R_2$, which may be the same or different, each represents an alkyl group having from 1 to 40 carbon atoms, an aryl group having from 6 to 40 carbon atoms, an acyl group having from 2 to 40 carbon atoms, an alkoxycarbonyl group having from 3 to 40 carbon atoms, a carbamoyl group having from 2 to 40 carbon atoms or an amino group, or $R_1$ and $R_2$ may form a ring or a dimer and at least one of $R_1$ and $R_2$ represents the acyl group, the alkoxycarbonyl group, the carbamoyl group or the amino group as defined above; X represents

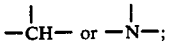

$R_3$ represents an alkyl group having from 1 to 20 carbon atoms or an aryl group having from 6 to 20 carbon atoms, or may be bonded to the benzene ring to form a dicyclic ring; and l represents an integer of not less than 2, wherein said compound which is capable of reacting with and fixing formaldehyde gas is loaded into an ultraviolet ray absorbing polymer latex which comprises a polymer or a copolymer having a repeating unit derived from a monomer represented by the following general formula (III):

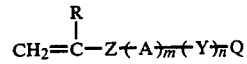

(III)

wherein R represents a hydrogen atom, a lower alkyl group having from 1 to 4 carbon atoms or a chlorine atom; Z represents —CONH—, —COO— or a phenylene group; A represents a linking group selected from an alkylene group having from 1 to 20 carbon atoms and an arylene group having from 6 to 20 carbon atoms; Y represents —COO—, —OCO—, —CONH—, —NHCO—, —$SO_2$NH—, —NH$SO_2$—, —$SO_2$— or —O—; m represents 0 or an integer of 1; n represents 0 or an integer of 1; and Q represents an ultraviolet ray absorbing group represented by the following general formula (IV):

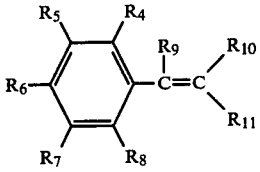

(IV)

wherein $R_4$, $R_5$, $R_6$, $R_7$ and $R_8$, which may be the same or different, each represents a hydrogen atom, a halogen atom, an alkyl group having from 1 to 20 carbon atoms, an aryl group having from 6 to 20 carbon atoms, an alkoxy group having from 1 to 20 carbon atoms, an aryloxy group having from 6 to 20 carbon atoms, an alkylthio group having from 1 to 20 carbon atoms, an arylthio group having from 6 to 20 carbon atoms, an amino group, an alkylamino group having from 1 to 20 carbon atoms, an arylamino group having from 6 to 20 carbon atoms, a hydroxyl group, a cyano group, a nitro group, an acylamino group, a carbamoyl group, a sulfonyl group, a sulfamoyl group, a sulfonamido group, an acyloxy group or an oxycarbonyl group, and $R_4$ and $R_5$, $R_5$ and $R_6$, $R_6$ and $R_7$ or $R_7$ and $R_8$ may form a 5- to 6-membered ring by ring closure; $R_9$ represents a hydrogen atom, an alkyl group having from 1 to 20 carbon atoms or an aryl group having from 6 to 20 carbon atoms; $R_{10}$ represents a cyano group, $—COOR_{12}$, $—CONHR_{12}$, $—COR_{12}$ or $—SO_2R_{12}$; $R_{11}$ represents a cyano group, $—COOR_{13}$, $—CONHR_{13}$, $—COR_{13}$ or $—SO_2R_{13}$; $R_{12}$ and $R_{13}$ each represents an alkyl group having from 1 to 20 carbon atoms or an aryl group having from 6 to 20 carbon atoms; and at least one of $R_4$, $R_5$, $R_6$, $R_7$, $R_8$, $R_9$, $R_{10}$ and $R_{11}$ bonds to the vinyl group through the linking group.

2. A silver halide color photographic light-sensitive material as claimed in claim 1, wherein the compound represented by the general formula (I) or (II) is a compound represented by the following general formula (I-1), (I-2), (I-3), (I-4), (I-5), (I-6), (I-7), (I-8), (I-9), (II-1) or (II-2):

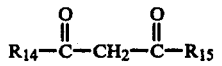
(I-1)

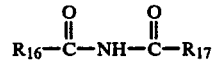
(I-2)

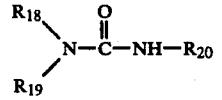
(I-3)

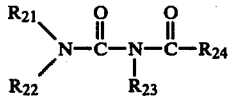
(I-4)

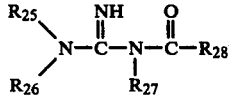
(I-5)

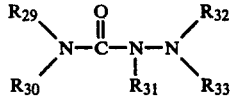
(I-6)

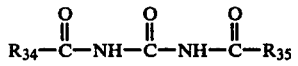
(I-7)

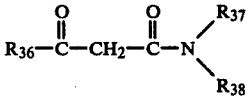
(I-8)

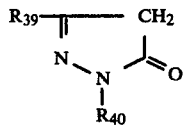
(I-9)

-continued

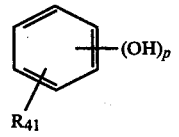
(II-1)

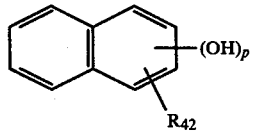
(II-2)

wherein $R_{14}$ to $R_{40}$ each represents a hydrogen atom, an alkyl group having from 1 to 40 carbon atoms, an aryl group having from 6 to 40 carbon atoms, an alkoxy group having from 1 to 40 carbon atoms or a carbamoyl group having from 2 to 40 carbon atoms and $R_{39}$ may be an arylamino group having 6 to 40 carbon atoms, and at least one of $R_{21}$, $R_{22}$ and $R_{23}$, at least one of $R_{25}$, $R_{26}$ and $R_{27}$, and at least one of $R_{29}$, $R_{30}$, $R_{31}$, $R_{32}$ and $R_{33}$ represents a hydrogen atom, or $R_{14}$ and $R_{15}$, $R_{16}$ and $R_{17}$, $R_{34}$ and $R_{35}$ may form a ring, and any two substituents selected from $R_{18}$ to $R_{20}$, from $R_{21}$ to $R_{24}$, from $R_{25}$ to $R_{28}$, from $R_{29}$ to $R_{33}$ and from $R_{36}$ to $R_{38}$ may form a ring; $R_{41}$ and $R_{42}$ each represents an alkyl group having from 1 to 20 or an aryl group having from 6 to 20 carbon atoms; p represents an integer from 2 to 5; and q represents an integer of not less than 2.

3. A silver halide color photographic light-sensitive material as claimed in claim 1, wherein R represents a hydrogen atom, a lower alkyl group having from 1 to 4 carbon atoms or a chlorine atom; Z represents —CONH—, —COO— or a phenylene group; A represents a linking group represented by an alkylene group having from 1 to 20 carbon atoms or an arylene group having from 6 to 20 carbon atoms; Y represents —COO—, —OCO—, —CONH—, —NHCO— or —O—; m represents 0 or an integer of 1; n represents 0 or an integer of 1; and Q represents an ultraviolet ray absorbing group represented by the general formula (IV) wherein $R_4$, $R_5$, $R_6$, $R_7$ and $R_8$ each represents a hydrogen atom, a halogen atom, an alkyl group having from 1 to 20 carbon atoms, an aryl group having from 6 to 20 carbon atoms, an alkoxy group having from 1 to 20 carbon atoms, an aryloxy group having from 6 to 20 carbon atoms, an alkylamino group having from 1 to 20 carbon atoms, an arylamino group having from 6 to 20 carbon atoms, a hydroxy group, an acylamino group, a carbamoyl group, an acyloxy group or an oxycarbonyl group, and $R_4$ and $R_5$, $R_5$ and $R_6$, $R_6$ and $R_7$ or $R_7$ and $R_8$ may form a 5- or 6-membered ring by ring closure; $R_9$ represents a hydrogen atom or an alkyl group having from 1 to 20 carbon atoms; $R_{10}$ represents a cyano group, $—COOR_{12}$, $—CONHR_{12}$, $—COR_{12}$ or $—SO_2R_{12}$; $R_{11}$ represents a cyano group, $—COOR_{13}$, $—CONHR_{13}$, $—COR_{13}$ or $—SO_2R_{13}$; and $R_{12}$ and $R_{13}$ each represents an alkyl group having from 1 to 20 carbon atoms or an aryl group having from 6 to 20 carbon atoms; wherein at least one of $R_4$, $R_5$, $R_6$, $R_7$, $R_8$, $R_9$, $R_{10}$ and $R_{11}$ bonds to the vinyl group through the linking group.

4. A silver halide color photographic light-sensitive material as claimed in claim 1, wherein the ultraviolet ray absorbing polymer latex comprises a homopolymer having a repeating unit derived from the monomer represented by the general formula (III).

5. A silver halide color photographic light-sensitive material as claimed in claim 1, wherein the ultraviolet ray absorbing polymer latex comprises a copolymer of the monomer represented by the general formula (III) with a copolymerizable monomer.

6. A silver halide color photographic light-sensitive material as claimed in claim 5, wherein the copolymerizable monomer is selected from the group consisting of an acrylic acid ester, an acrylic acid amide, a vinyl ester, an acrylonitrile, a methacrylonitrile, an aromatic vinyl compound, itaconic acid, citraconic acid, crotonic acid, vinylidene chloride, a vinyl alkyl ether, a maleic acid ester, N-vinyl-2-pyrrolidone, N-vinylpyridine, and 2- and 4-vinylpyridine.

7. A silver halide color photographic light-sensitive material as claimed in claim 5, wherein the copolymerizable monomer is selected from the group consisting of an acrylic acid ester, a methacrylic acid ester and an aromatic vinyl compound.

8. A silver halide color photographic light-sensitive material as claimed in claim 1, wherein the ultraviolet ray absorbing polymer latex is a latex prepared by emulsion polymerization of monomers comprising the monomer represented by the general formula (III).

9. A silver halide color photographic light-sensitive material as claimed in claim 1, wherein the ultraviolet ray absorbing polymer latex is a latex prepared by dissolving an oleophilic polymer ultraviolet ray absorbing agent obtained by polymerization of monomers comprising the monomer represented by the general formula (III) in an organic solvent and then dispersing the solution in a latex form in an aqueous gelatin solution.

10. A silver halide color photographic light-sensitive material as claimed in claim 1, wherein the proportion of the ultraviolet ray absorbing agent portion in the ultraviolet ray absorbing polymer latex is from 5 to 100% by weight.

11. A silver halide color photographic light-sensitive material as claimed in claim 1, wherein the proportion of the ultraviolet ray absorbing agent portion in the ultraviolet ray absorbing polymer latex is from 50 to 100% by weight.

12. A silver halide color photographic light-sensitive material as claimed in claim 1, wherein the ultraviolet ray absorbing polymer latex in which an aldehyde scavenger compound represented by the general formula (I) or (II) is loaded is a latex prepared by loading the compound represented by the general formula (I) or (II) into the ultraviolet ray absorbing polymer latex having a repeating unit derived from a monomer represented by the general formula (III).

13. A silver halide color photographic light-sensitive material as claimed in claim 1, wherein the ultraviolet ray absorbing polymer latex in which an aldehyde scavenger compound represented by the general formula (I) or (II) is loaded is a latex prepared by dissolving an ultraviolet ray absorbing polymer having a repeating unit derived from a monomer represented by the general formula (III) and the aldehyde scavenger compound represented by the general formula (I) or (II) in an organic solvent having a low boiling point and then emulsifying the solution in an aqueous phase.

14. A silver halide color photographic light-sensitive material as claimed in claim 1, wherein the aldehyde scavenger compound represented by the general formula (I) or (II) is present in an amount within the range from 50% to 300% by weight based on the amount of the polymer having a repeating unit derived from a monomer represented by the general formula (III).

15. A silver halide color photographic light-sensitive material as claimed in claim 1, wherein the aldehyde scavenger compound represented by the general formula (I) or (II) is present in an amount within the range from 100% to 200% by weight based on the amount of the polymer having a repeating unit derived from a monomer represented by the general formula (III).

16. A silver halide color photographic light-sensitive material as claimed in claim 1, wherein the aldehyde scavenger compound which is loaded into the ultraviolet ray absorbing polymer latex is present in a surface protective layer, an intermediate layer, a silver halide emulsion layer or a subbing layer.

17. A silver halide color photographic light-sensitive material as claimed in claim 1, wherein the aldehyde scavenger compound which is loaded into the ultraviolet ray absorbing polymer latex is present in a surface protective layer or a hydrophilic colloid layer adjacent to the surface protective layer.

18. A silver halide color photographic light-sensitive material as claimed in claim 17, wherein the surface protective layer is composed of two separate layers and the lower layer thereof contains the aldehyde scavenger compound which is loaded into the ultraviolet ray absorbing polymer latex.

19. A silver halide color photographic light-sensitive material as claimed in claim 1, wherein the ultraviolet ray absorbing polymer latex is present in an amount within the range of 10 to 4,000 mg/m$^2$ of the material.

20. A silver halide color photographic light-sensitive material as claimed in claim 1, wherein the ultraviolet ray absorbing polymer latex is present in an amount within the range of 50 to 2,000 mg/m$^2$ of the material.

21. A silver halide color photographic light-sensitive material as claimed in claim 1, wherein the aldehyde scavenger is present in an amount within the range of 10 to 10,000 mg/m$^2$ of the material.

22. A silver halide color photographic light-sensitive material as claimed in claim 1, wherein the aldehyde scavenger is present in an amount within the range of 50 to 5,000 mg/m$^2$ of the material.

23. A silver halide color photographic light-sensitive material as claimed in claim 1, wherein the silver halide emulsion layer contains a color forming coupler.

24. A silver halide color photographic light-sensitive material as claimed in claim 23, wherein the color forming coupler is selected from the group consisting of a magenta coupler, a yellow coupler and a cyan coupler.

25. A silver halide color photographic light-sensitive material as claimed in claim 23, wherein the color forming coupler is a colored coupler or a development inhibitor releasing coupler.

26. A silver halide color photographic light-sensitive material as claimed in claim 23, wherein the color forming coupler is a polymeric coupler.

27. A silver halide color photographic light-sensitive material as claimed in claim 23, wherein the color forming coupler is a 4-equivalent magenta coupler.

28. A silver halide color photographic light-sensitive material as claimed in claim 27, wherein the 4-equivalent magenta coupler is selected from the group consisting of an oil-soluble magenta coupler containing a hydrophobic group, a Fisher type magenta coupler containing both a hydrophobic group and a hydrophilic group, and a magenta polymer coupler latex.

29. A silver halide color photographic light-sensitive material as claimed in claim 28, wherein the oil-soluble magenta coupler is an oil-soluble 5-pyrazolone coupler.

30. A silver halide color photographic light-sensitive material as claimed in claim 28, wherein the magenta polymer coupler latex is a polymer or copolymer having a repeating unit derived from a monomer coupler represented by the following general formula (V):

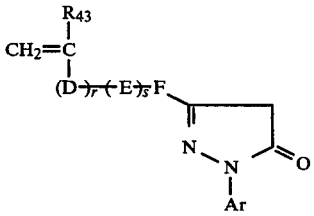

(V)

wherein $R_{43}$ represents a hydrogen atom, a lower alkyl group containing from 1 to 4 carbon atoms or a chlorine atom; F represents —CONH—, —NH—, —NHCONH— or —NHCOO—; D represents —CONH— or —COO—; E represents a divalent connecting group which is selected from one or more members of the group consisting of a substituted or unsubstituted alkylene group having from 1 to 10 carbon atoms, a substituted or unsubstituted alkenylene group, a substituted or unsubstituted phenylene group, —O—, —S—, —SO—, —$SO_2$—, —CO—, —NH—, —CONH— and —COO—; Ar represents an unsubstituted or substituted phenyl group; r represents 0 or 1; and s represents 0 or 1.

31. A silver halide color photographic light-sensitive material as claimed in claim 30, wherein the substituent for the alkylene group, the alkenylene group or the phenylene group represented by E is selected from the group consisting of an aryl group, a nitro group, a hydroxy group, a cyano group, a sulfo group, an alkoxy group, an aryloxy group, an acyloxy group, an acylamino group, a sulfonamido group, a sulfamoyl group, a halogen atom, a carboxy group, a carbamoyl group, an alkoxycarbonyl group, and a sulfonyl group.

32. A silver halide color photographic light-sensitive material as claimed in claim 30, wherein the substituent for the phenyl group represented by Ar is selected from the group consisting of an alkyl group, an alkoxy group, an aryloxy group, an alkoxycarbonyl group, an acylamino group, a carbamoyl group, an alkylcarbamoyl group, a dialkylcarbamoyl group, an arylcarbamoyl group, an alkylsulfonyl group, an arylsulfonyl group, an alkylsulfonamido group, an arylsulfonamido group, a sulfamoyl group, an alkylsulfamoyl group, a dialkylsulfamoyl group, an alkylthio group, an arylthio group, a cyano group, a nitro group, and a halogen atom.

33. A silver halide color photographic light-sensitive material as claimed in claim 30, wherein the substituent for the phenyl group represented by Ar is selected from the group consisting of a halogen atom, an alkyl group, an alkoxy group, an alkoxycarbonyl group, and a cyano group.

34. A silver halide color photographic light-sensitive material as claimed in claim 30, wherein the polymer is a homopolymer.

35. A silver halide color photographic light-sensitive material as claimed in claim 30, wherein the polymer is a copolymer.

36. A silver halide color photographic light-sensitive material as claimed in claim 35, wherein the copolymer contains a repeating unit derived from a non-color forming monomer which does not couple with an oxidation product of an aromatic primary amine developing agent.

37. A silver halide color photographic light-sensitive material as claimed in claim 36, wherein the non-color forming monomer is selected from the group consisting of an acrylic acid ester, an acrylic acid amide, a vinyl ester, an acrylonitrile, a methacrylonitrile, an aromatic vinyl compound, itaconic acid, citraconic acid, crotonic acid, vinylidene chloride, a vinyl alkyl ether, an ester of maleic acid, N-vinyl-2-pyrrolidone, N-vinylpyridine, and 2- or 4-vinylpyridine.

38. A silver halide color photographic light-sensitive material as claimed in claim 36, wherein the non-color forming monomer is selected from the group consisting of an acrylic acid ester, a methacrylic acid ester and a maleic acid ester.

39. A silver halide color photographic light-sensitive material as claimed in claim 30, wherein the proportion of the color forming portion in the magenta polymer coupler latex is from 5% to 80% by weight.

40. A silver halide color photographic light-sensitive material as claimed in claim 30, wherein the proportion of the color forming portion in the magenta polymer coupler latex is from 20% to 70% by weight.

41. A silver halide color photographic light-sensitive material as claimed in claim 39, wherein the gram number of the magenta polymer coupler latex containing 1 mol of coupler monomer is from 250 to 3,000.

42. A silver halide color photographic light-sensitive material as claimed in claim 30, wherein the magenta polymer coupler latex is a latex prepared by an emulsion polymerization method.

43. A silver halide color photographic light-sensitive material as claimed in claim 30, wherein the magenta polymer coupler latex is a latex prepared by dissolving a lipophilic polymer coupler obtained by the polymerization of a monomer coupler in an organic solvent and then dispersing the solution in a latex form in an aqueous gelatin solution.

44. A silver halide color photographic light-sensitive material as claimed in claim 27, wherein the silver halide emulsion layer is a green-sensitive silver halide emulsion layer.

45. A silver halide color photographic light-sensitive material as claimed in claim 44, wherein the photographic light-sensitive material further comprises a blue-sensitive silver halide emulsion layer containing a yellow color image forming coupler and a red-sensitive silver halide emulsion layer containing a cyan color image forming coupler.

46. A silver halide color photographic light-sensitive material as claimed in claim 1, wherein the ultraviolet ray absorbing polymer latex is present in an amount in the range of 10 mg to 4,000 mg/$m^2$ of material.

47. A silver halide color photographic light-sensitive material as claimed in claim 46, wherein the ultraviolet ray absorbing polymer latex is present in an amount in the range of 50 mg to 2,000 mg/$m^2$ of material.

48. A silver halide color photographic light-sensitive material as claimed in claim 1, wherein the aldehyde scavenger compound is present in an amount in the range of 10 mg to 10,000 mg/$m^2$ of material.

49. A silver halide color photographic light-sensitive material as claimed in claim 48, wherein the aldehyde scavenger compound is present in an amount in the range of 50 mg to 5,000 mg/$m^2$ of material.

* * * * *